US010561886B2

(12) United States Patent
Bassoo

(10) Patent No.: US 10,561,886 B2
(45) Date of Patent: Feb. 18, 2020

(54) SAND TRAINING BAG

(71) Applicant: Naipaul Bassoo, Toronto (CA)

(72) Inventor: Naipaul Bassoo, Toronto (CA)

( * ) Notice: Subject to any disclaimer, the term of this patent is extended or adjusted under 35 U.S.C. 154(b) by 92 days.

(21) Appl. No.: 15/983,505

(22) Filed: May 18, 2018

(65) Prior Publication Data

US 2019/0351277 A1 Nov. 21, 2019

(51) Int. Cl.

| | |
|---|---|
| ***A63B 21/06*** | (2006.01) |
| ***A63B 21/00*** | (2006.01) |
| ***A63B 21/065*** | (2006.01) |
| ***A63B 21/068*** | (2006.01) |
| ***A63B 69/00*** | (2006.01) |

(Continued)

(52) U.S. Cl.

CPC ..... *A63B 21/0603* (2013.01); *A63B 6/00* (2013.01); *A63B 21/065* (2013.01); *A63B 21/068* (2013.01); *A63B 21/4007* (2015.10); *A63B 21/4037* (2015.10); *A63B 69/0093* (2013.01);

(Continued)

(58) Field of Classification Search

CPC .. A63B 6/00; A63B 6/02; A63B 6/025; A63B 21/0004; A63B 21/00058; A63B 21/00061; A63B 21/00065; A63B 21/00069; A63B 21/00076; A63B 21/00189; A63B 21/0603; A63B 21/0605; A63B 21/065; A63B 21/068; A63B 21/08; A63B 21/16; A63B 21/4007; A63B 21/4009; A63B 21/4023; A63B 21/4027; A63B 21/4037; A63B 21/4039; A63B 21/4041; A63B 21/4043; A63B 23/035; A63B 23/03508; A63B 23/03516; A63B 23/03525; A63B 23/0355; A63B 23/03575; A63B 23/04; A63B 23/0405; A63B 23/047; A63B 23/0482; A63B 23/0494; A63B 23/12; A63B 23/1209; A63B 23/1236; A63B 23/1245; A63B 23/1281; A63B 2023/0411; A63B 26/00; A63B 26/003; A63B 69/0093; A63B 71/0036; A63B 71/0054; A63B 71/02; A63B 71/023; A63B 2071/0063; A63B 2071/0072; A63B 2071/009; A63B 2071/026; A63B 2071/027; A63B 2210/00; A63B 2210/50; A63B 2225/09; A63B 2225/093

See application file for complete search history.

(56) References Cited

U.S. PATENT DOCUMENTS 2,879,830 A * 3/1959 Johnson ..... A63B 27/00 182/9
4,517,920 A * 5/1985 Yamamoto ..... A01K 1/0107 119/166
5,983,832 A * 11/1999 Seo ..... A01K 1/0114 119/166

(Continued)

FOREIGN PATENT DOCUMENTS

CN 204159035 U * 2/2015 ..... A63H 33/00

*Primary Examiner* — Gary D Urbiel Goldner

(57) ABSTRACT

Described is a sand training bag for sand training. It includes a set of bag walls which includes a training surface wall and a perimeter wall. The sand training bag is transitionable between a closed bag configuration in which the set of bag walls defines a bag chamber to an open pit configuration in which the set of bag walls forms a sand training pit with the training surface wall forming a floor of the sand training pit and the perimeter wall forming a perimeter side wall of the sand training pit, the sand training pit being provided to receive and hold a quantity of sand.

16 Claims, 27 Drawing Sheets

(51) Int. Cl.
*A63B 6/00* (2006.01)
*A63B 23/04* (2006.01)

(52) U.S. Cl.
CPC ... *A63B 2023/0411* (2013.01); *A63B 2210/50* (2013.01)

(56) References Cited

U.S. PATENT DOCUMENTS 5,984,809 A * 11/1999 Hadar ..... A63B 69/345 473/444
6,640,856 B1 * 11/2003 Tucker ..... A45C 7/0077 150/130
8,276,351 B1 * 10/2012 Henkin ..... A63B 21/00058 482/89
8,905,405 B1 * 12/2014 Burns, Sr. ..... A63B 67/06 273/336
D821,510 S * 6/2018 Buikema ..... A63B 21/065 D21/683
2007/0049469 A1 * 3/2007 Brown ..... A45C 3/00 482/93
2007/0186519 A1 * 8/2007 Vaughn ..... B68C 1/02 54/46.1
2010/0048363 A1 * 2/2010 Gilberti ..... A63B 21/0603 482/105
2011/0287904 A1 * 11/2011 Morris ..... A63B 21/0602 482/93
2012/0011773 A1 * 1/2012 Cross ..... A01G 9/026 47/65.8
2012/0129659 A1 * 5/2012 Diaz ..... A63B 17/00 482/51
2014/0011643 A1 * 1/2014 Jaidar ..... A63B 21/072 482/93
2014/0206508 A1 * 7/2014 Hall ..... A63B 21/065 482/105
2016/0129292 A1 * 5/2016 Stroup ..... A63B 21/00065 482/93
2018/0333603 A1 * 11/2018 Peyton ..... A63B 21/072
2019/0153743 A1 * 5/2019 Perreault ..... E04H 12/2246

* cited by examiner

SAND TRAINING BAG

FIELD OF THE INVENTION

The present specification relates generally to training bags, and specifically to training bags for use in sand training.

BACKGROUND OF THE INVENTION

Sand training involves performing one or more of a variety of exercises or activities on a sand surface. Sand is a low impact surface and can be used for a variety of exercises or activities, such as for exercises to help heal lower extremity injuries such as to the gluteal maximus, medium and minimus, iliotibial band, hip flexor, ACL, MLC, meniscus, quadriceps, hamstring, or calf, or to help heal tibialis/fibrosis, or achilles tears or strains or ruptures.

The user of a sand surface may perform an activity during which the sand acts as a light resistance to movements, such as dry squats, single leg deadlights or Romanian deadlift, basic jumps, medial or lateral acceleration, pronation, supination, dorsiflexion and plantarflexion of the ankle. A user can incorporate a great many training techniques into a sand training exercise or activity, for example as a user progresses from a specific lower body extremity exercise, such as those listed above, the user can incorporate plyometric training, such as with the approval of a medical professional.

Sand training can also be used to simulate other surfaces. For example, users interested in surfing can use sand as an acting wave, since the surface is unstable, to assist them in working on balance in multiple directions.

SUMMARY OF THE INVENTION

In an embodiment of the present invention, there is provided a sand training bag for sand training, comprising a set of bag walls including a training surface wall and a perimeter wall, and wherein the sand training bag is transitionable between a closed bag configuration in which the set of bag walls defines a bag chamber to an open pit configuration in which the set of bag walls forms a sand training pit with the training surface wall forming a floor of the sand training pit and the perimeter wall forming a perimeter side wall of the sand training pit, the sand training pit provided to receive and hold a quantity of sand.

BRIEF DESCRIPTION OF THE DRAWINGS

The principles of the invention may better be understood with reference to the accompanying figures provided by way of illustration of an exemplary embodiment, or embodiments, incorporating principles and aspects of the present invention, and in which.

DETAILED DESCRIPTION OF THE EMBODIMENTS

Figure 1:
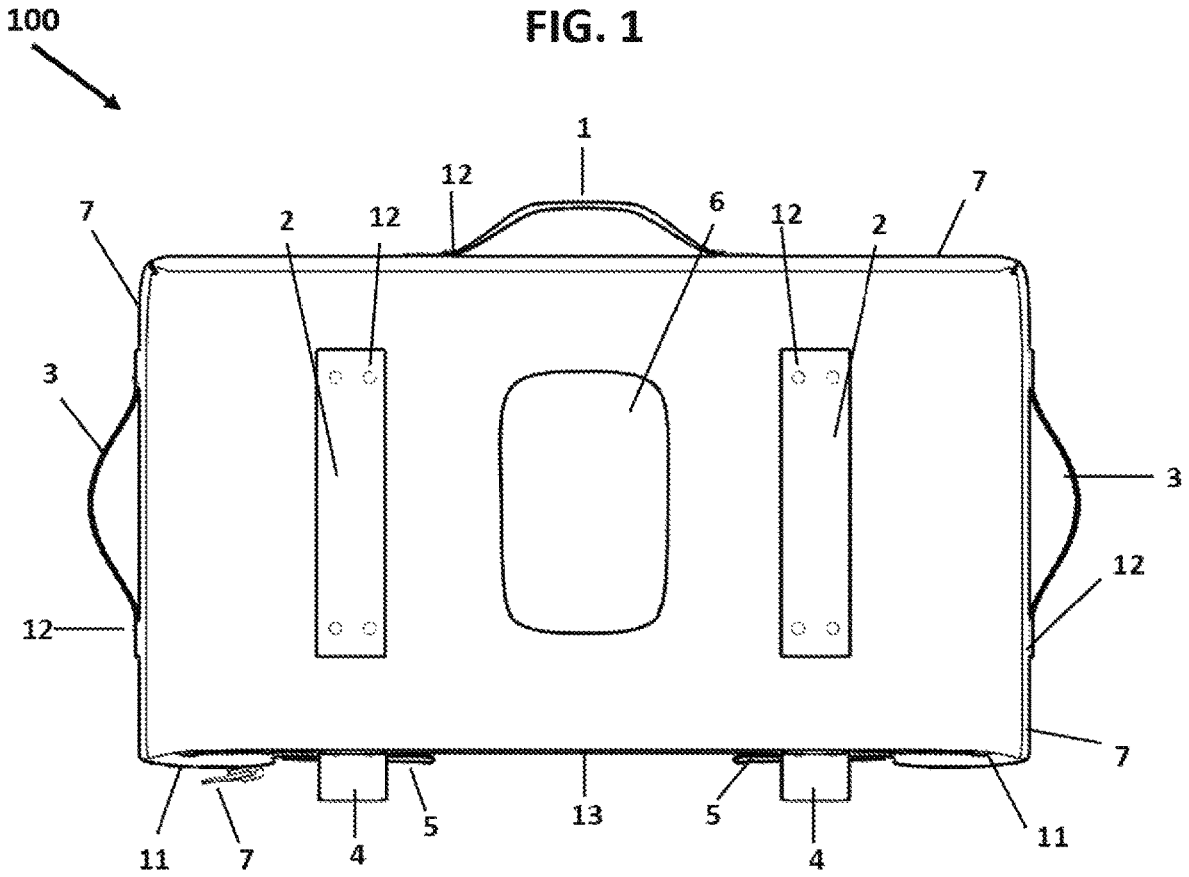
FIG. 1 is a front side elevation view of a sand training bag according to an embodiment, in a closed configuration.
Figure 2:
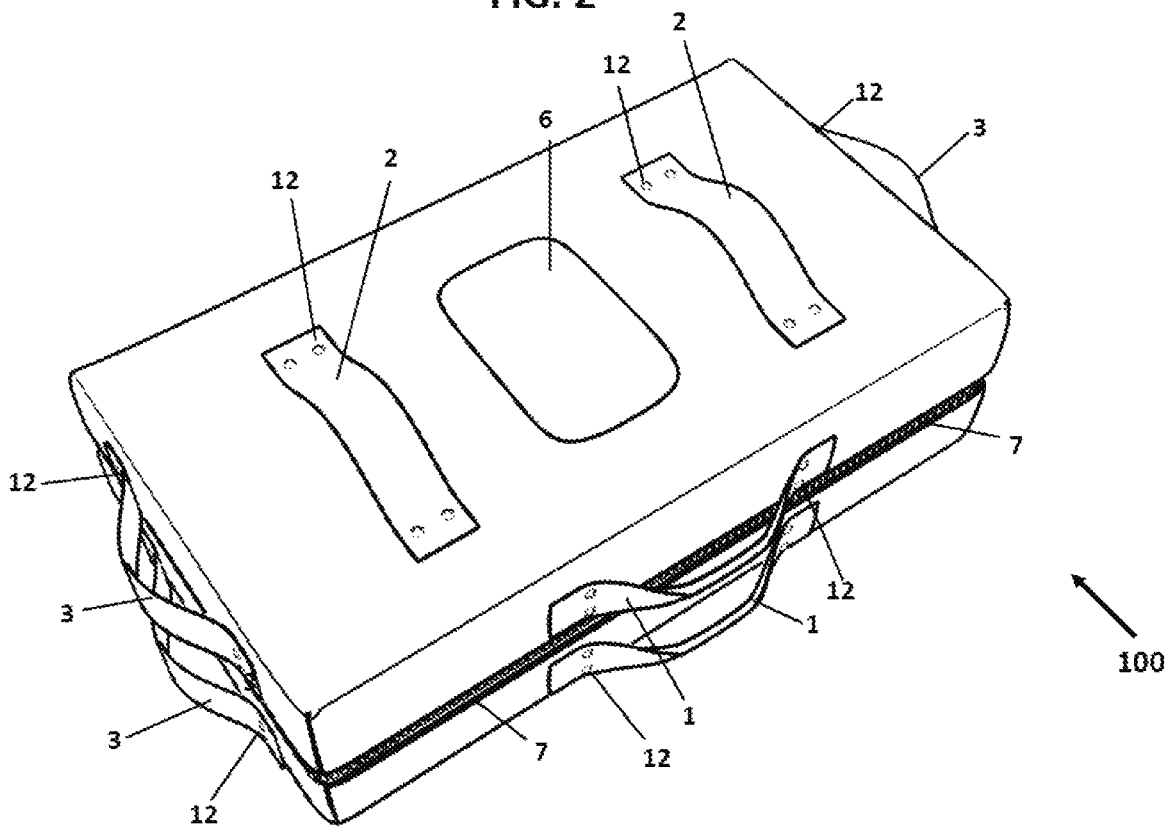
FIG. 2 is a perspective view of a sand training bag according to the embodiment of FIG. 1 in a closed configuration.
Figure 3:
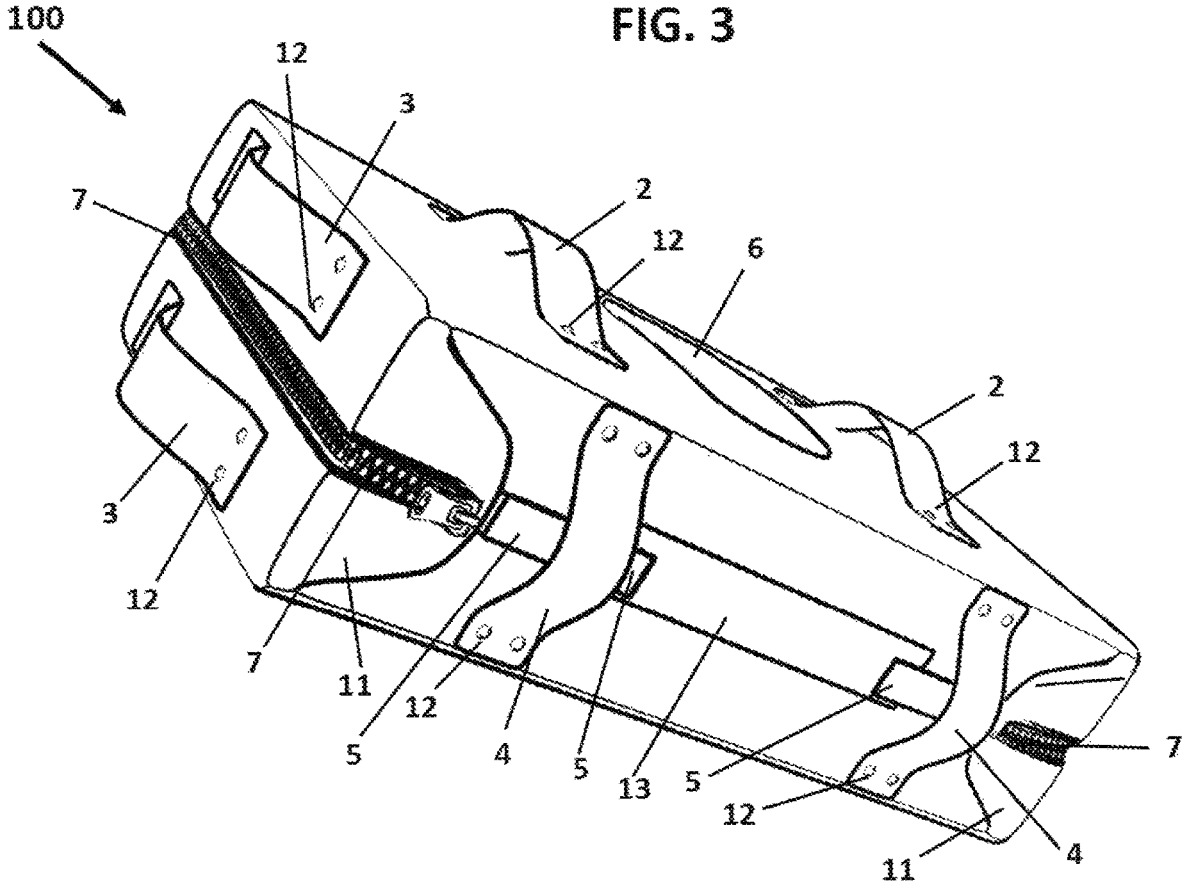
FIG. 3 is a perspective side view of a sand training bag according to the embodiment of FIG. 1 in a closed configuration.
Figure 4:
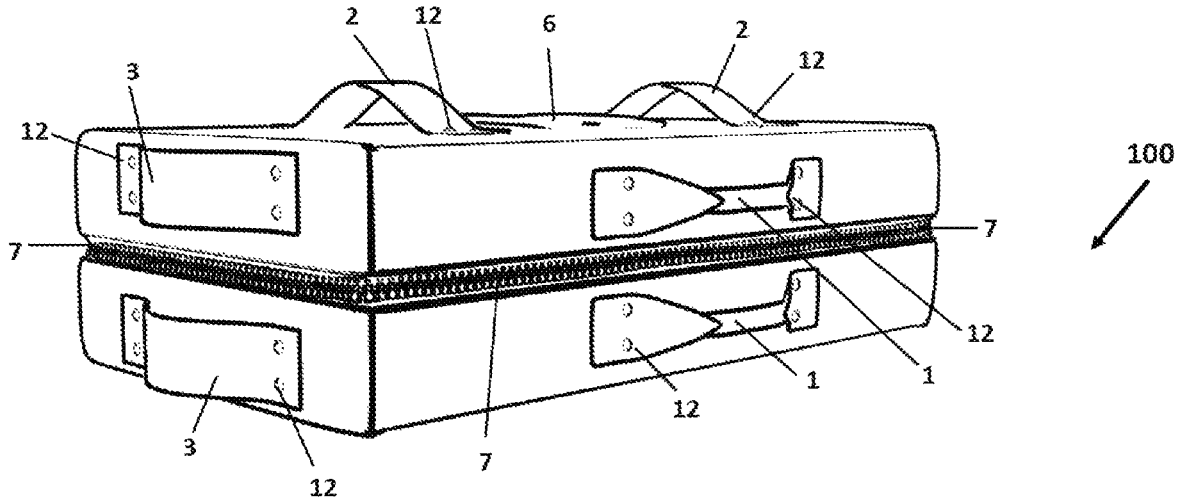
FIG. 4 is a perspective view of a sand training bag according to the embodiment of FIG. 1 in a closed configuration.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like part are marked throughout the specification and the drawings with the same respective reference numerals. The drawings are not necessarily to scale and in some instances proportions may have been exaggerated in order more clearly to depict certain features of the invention.

The invention is a sand training bag; a training bag which can be opened for use as a sand pit to provide a sand training surface. In some embodiments the sand training bag also incorporates handles and other features to allow it to be used in a variety of other exercises, such as to be used as a weight to be lifted or dragged. Schematic drawings of a sand training bag 200 being used in a variety of example exercises are shown in FIGS. 24 to 28.

An embodiment of the invention is shown in FIGS. 1 to 8 in a closed bag configuration and in FIGS. 9 to 16 in an open pit configuration. As depicted in FIGS. 1 to 16, a sand training bag is disclosed, which may be configured as a bag 100 or as a sand pit 101. In a bag configuration 100, the sand training bag defines an interior chamber, such as provided to hold workout clothing, workout equipment, or other items that a user may wish to carry with them. In a sand pit configuration 101, the sand training bag defines a pit for receiving and containing a layer or surface of sand upon which exercises may be performed by a user. In a sand pit configuration 101, the sand training bag forms a sand support surface 10 for exercises and activities. The sand training bag is a portable multi-purpose piece of equipment.

In the embodiment depicted, sand training bag 100 includes top side handles 1, face and rear side handles 2, right and left side handles 3, and bottom side handles 4, each handle secured to an external surface of the bag via a set of two pairs of rivets 12, one pair securing each end of the handle. In some embodiments, the handles are made of seat belt webbing and secured using metal rivets, such as copper rivets. In some embodiments, each handle 1, 2, 3, 4 has a length of between 6 and 12 centimeters, a height of between 1 and 4 centimeters, and a width of between 1 and 2 centimeters.

Many rehabilitation exercises following injuries, such as sports injuries, benefit from the performance of the exercises on a sand surface, such as sand surface 10 when covered with a layer of sand. Overhead and back squats, deadlifts, lunges, bicep curls, and triceps overhead extension are a few strength training exercises that can involve a sand training bag according to some embodiments. Often there are benefits to doing many such exercises and activities while standing on a sand surface, such as sand surface 10 when covered with a layer of sand.

In some embodiments the sand training bag will contain features to allow the bag to be used in a variety of exercises in addition to sand training exercises. In some embodiments a sand training bag will include handles, both for carrying the sand training bag when in a bag configuration and to allow the sand training bag to be used as a weight for weight training. Some weight training exercises, such as Olympic lifting, involve a power explosive movement taught frequently. For such exercises, the sand training bag, such as in a closed configuration 100 and when weighted down with a predetermined quantity of sand filler, can be substituted for the barbell, such as in a beginner's class. This may reduce injury rates for beginners, since the training bag may be less likely to cause hyperextension to the wrist.

In some embodiments, the sand training bag will include a harness to allow the user to use the training bag as resistance. For example, in some embodiments the bag includes a metal ring attached to a handle of the sand training bag, such as sand training bag 100, which will attach to a removable harness for a user's upper body. The user can then jog or run while wearing the harness and dragging the sand training bag for conditioning, speed and acceleration training. Once the user has completed the exercise with the harness, the user can place the harness inside the sand training bag, such as sand training bag 100, to transport to a desired destination.

Figure 22:
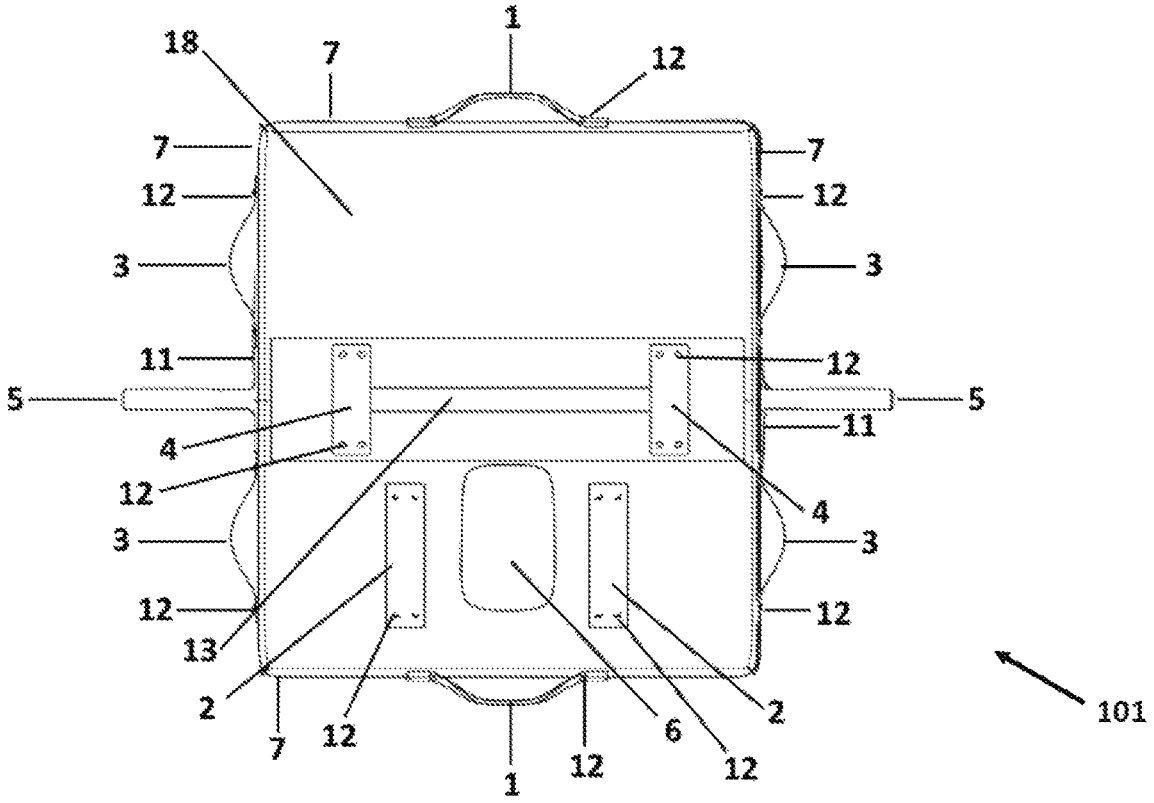
FIG. 22 is a perspective view of a sand training bag with a flat surface rear face for use as a dragged resistance, according to an embodiment.
Figure 23:
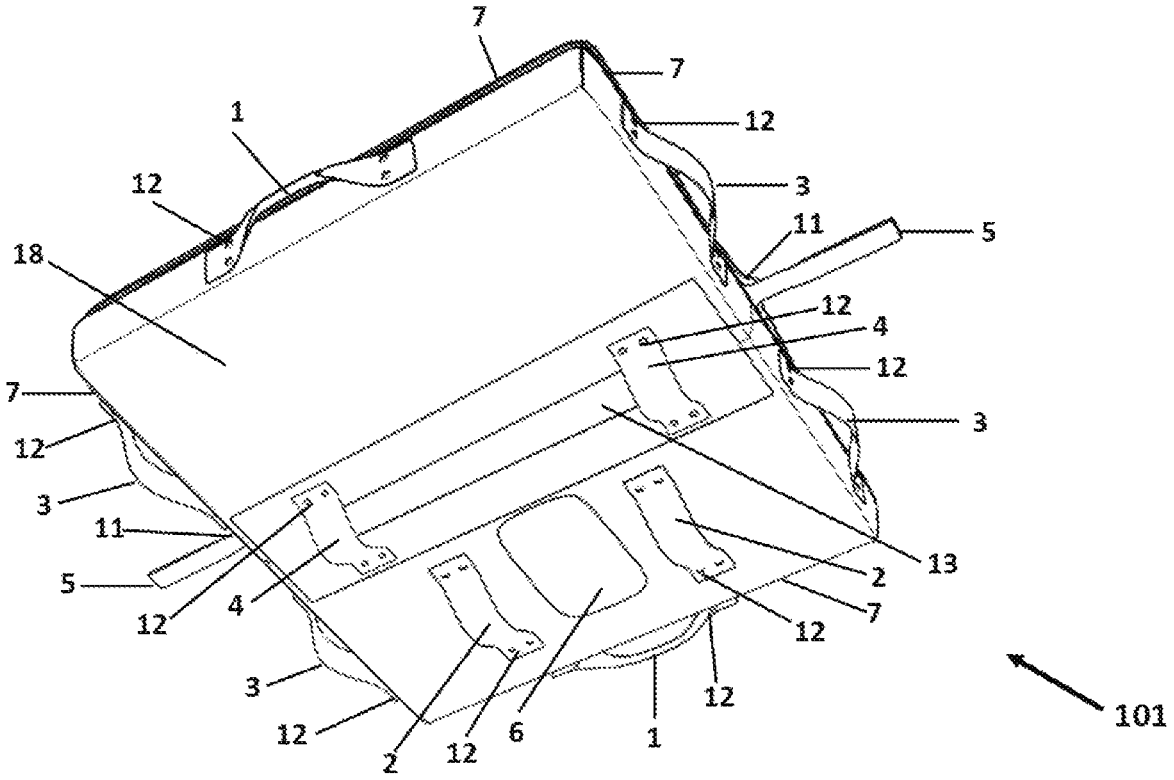
FIG. 23 is a perspective view of the sand training bag with a flat surface rear face according to the embodiment of FIG. 22.
Figure 24:
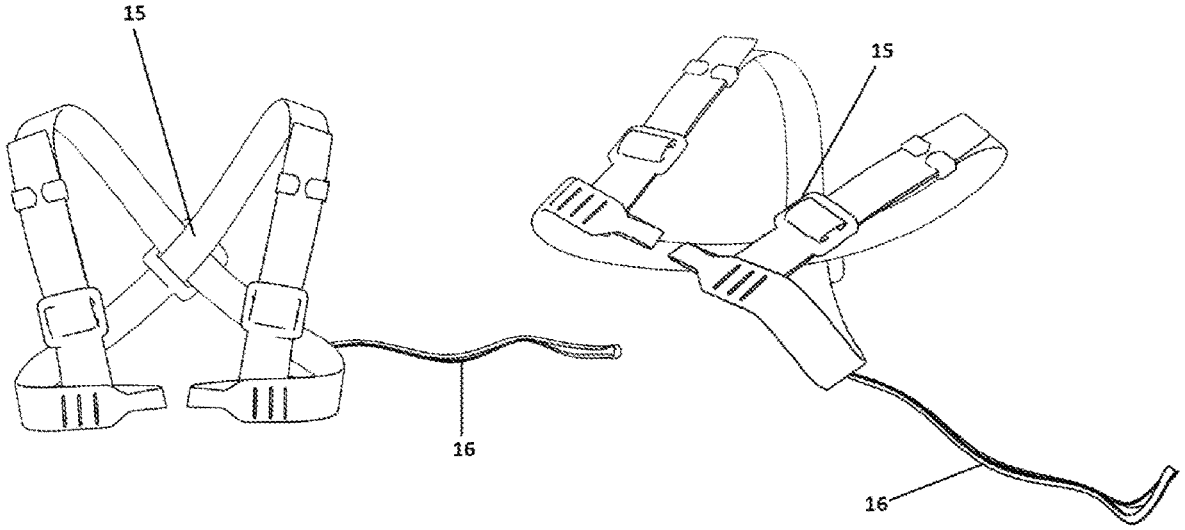
FIG. 24 is a perspective view of a harness and strap for use with a training bag, according to an embodiment.
Figure 25:
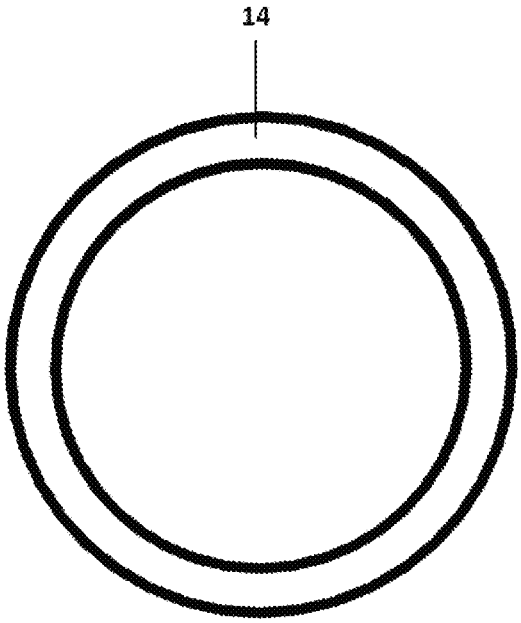
FIG. 25 is a perspective view of a ring according to an embodiment for use with a harness and strap.
Figure 26:
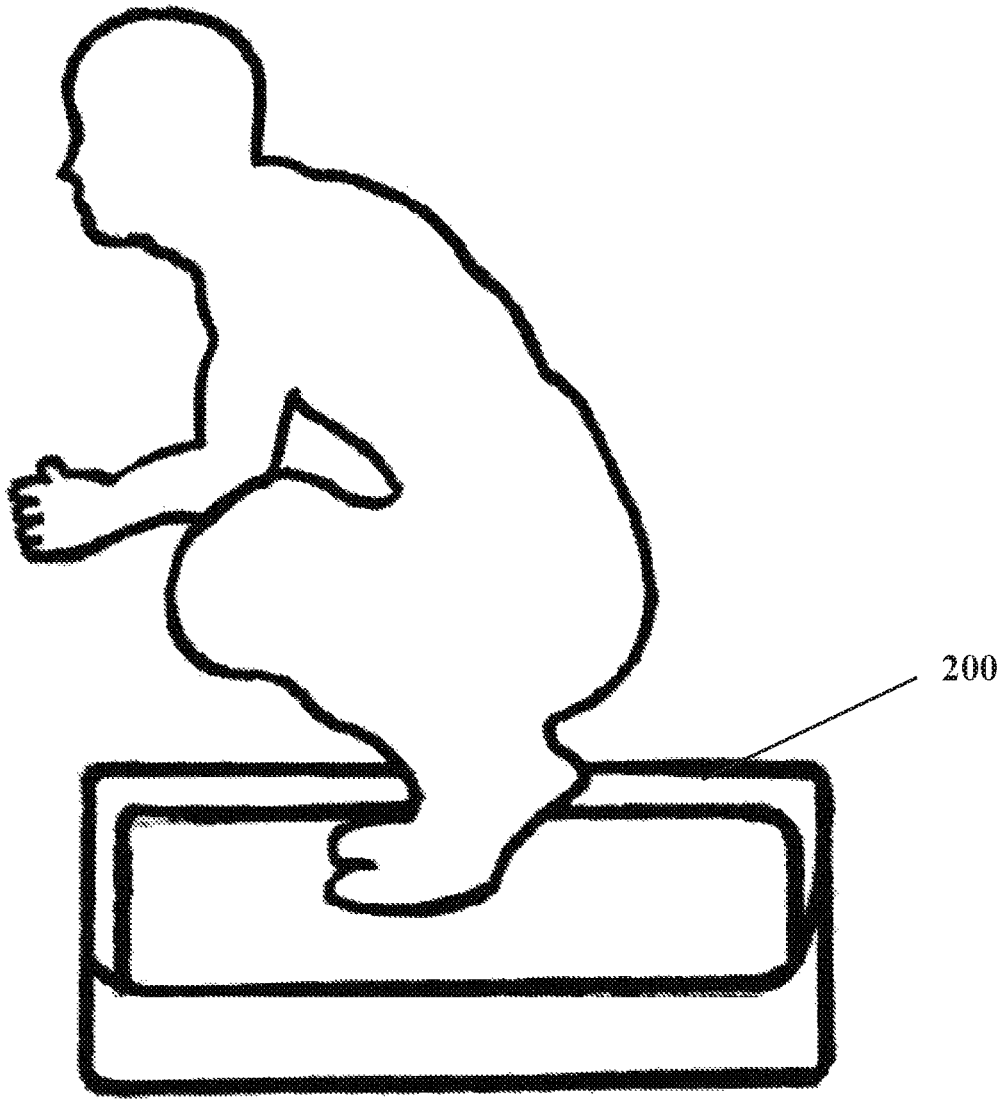
FIG. 26 is a schematic view of a user using a sand training bag for a squatting exercise.
Figure 27:
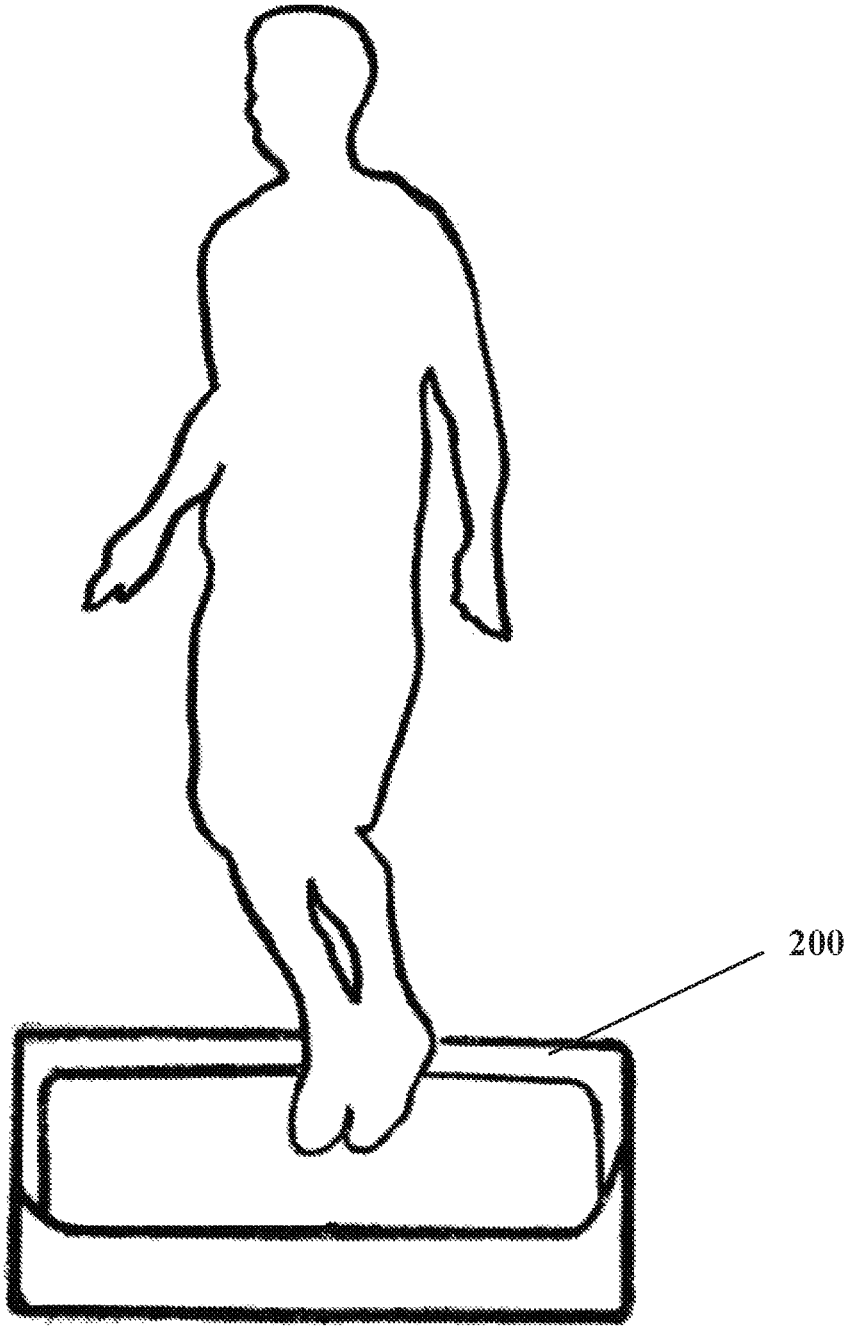
FIG. 27 is a schematic view of a user using a sand training bag for a jumping exercise.
Figure 28:
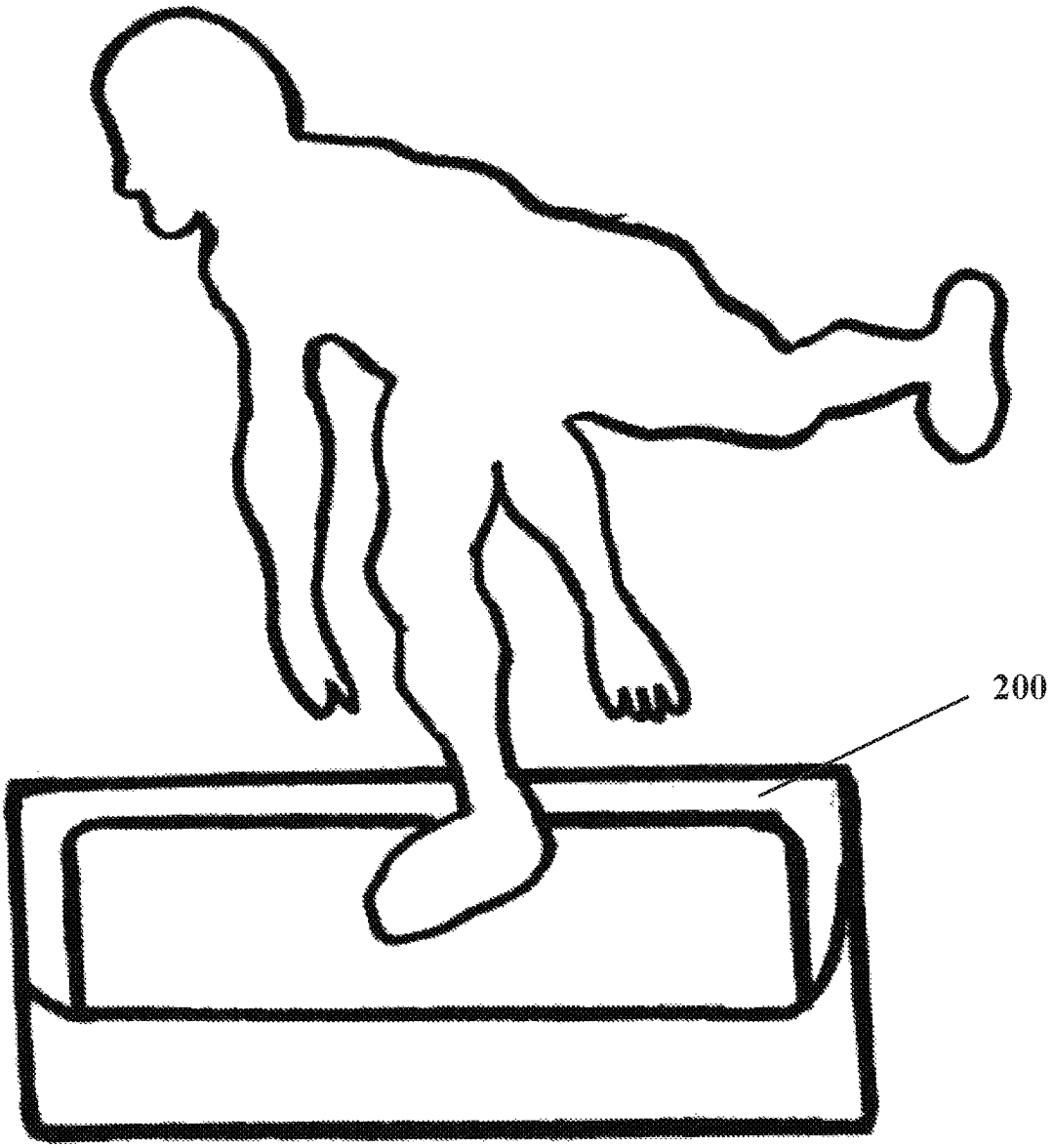
FIG. 28 is a schematic view of a use using a sand training bag for a single leg deadlift exercise.
Figure 29:
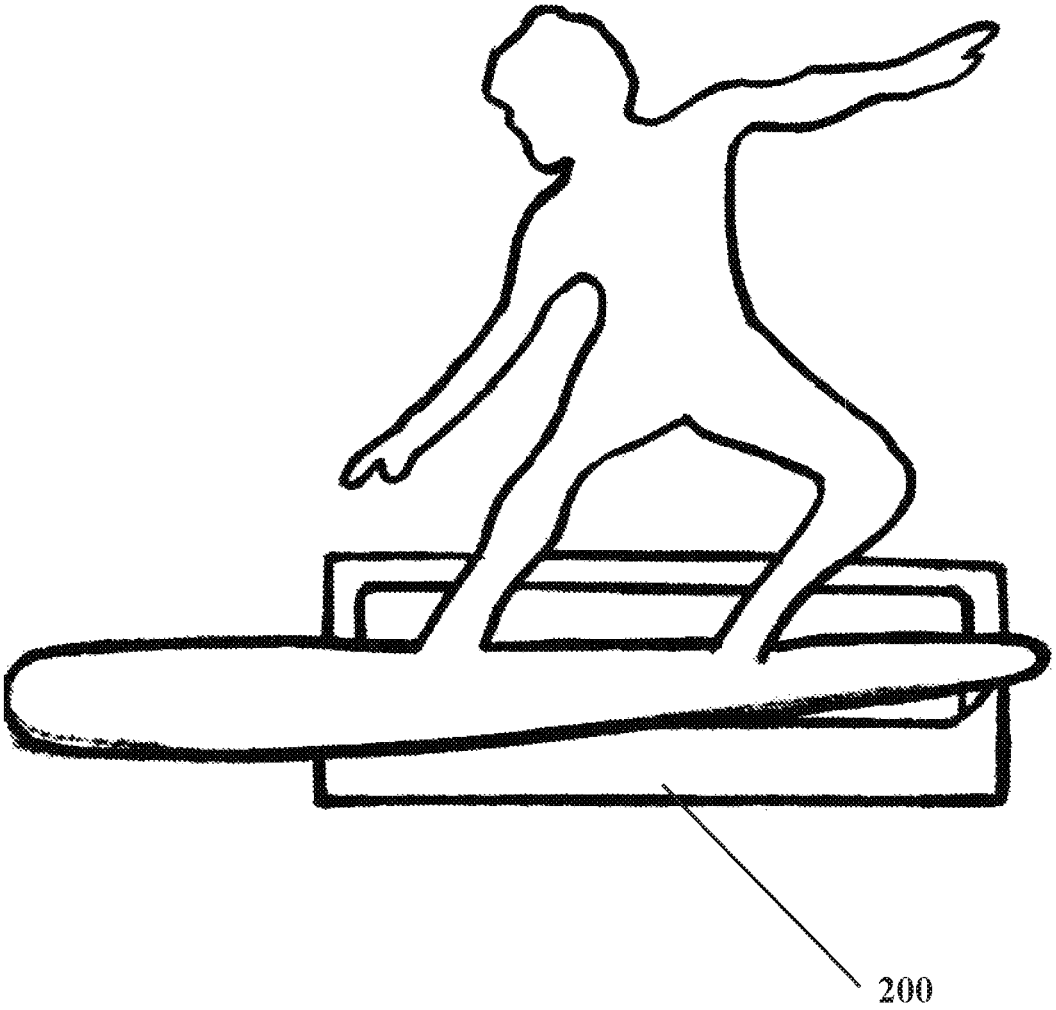
FIG. 29 is a schematic view of a user using a sand training bag for a surfing exercise.
Figure 30:
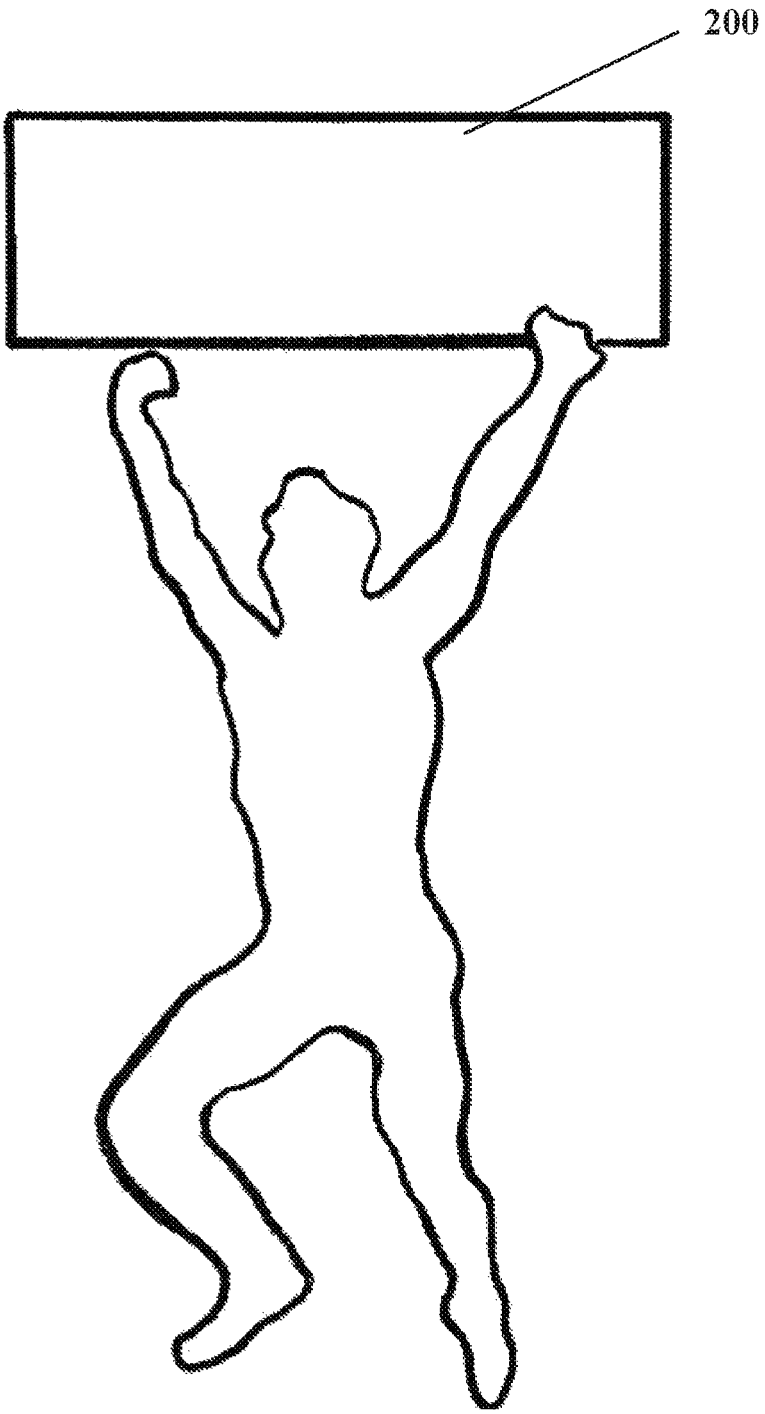
FIG. 30 is a schematic view of a user lifting a sand training bag over the user's head in a lifting exercise.

In some embodiments, such as if the user intends to use the bag with the harness and strap attached to the sand training bag 100 in a closed configuration as a dragged resistance, the external surface of one side of the bag may be flat without handles or other attachments. In the embodiment depicted in FIGS. 22 and 23, rear face 18 is a flat surface, which may be made from rubber and other material reducing any structural damage to the exterior of the sand training bag 100 when the bag is dragged along the ground.

When used to provide a sand surface 10 covered with a layer of sand for exercises or activities, the sand training bag may be beneficial in being a shifting surface or a low impact surface, which may be particularly useful for indoor training where a low impact surface may not otherwise be available. For example, a low impact sand surface 10 can be beneficial while conducting snatches and cleans and other specific Olympic movements.

When the sand training bag is in an open pit configuration 101 in which a layer of sand is received, the sand pit may be used for a variety of activities including speed and agility drills such as high knees, but kicks, lateral hops, and countermovement jumps. Another use of this sand training bag as a sand pit 101, is for physical rehabilitation of upper and lower extremity injuries, such as broken, fractured, or sprained wrists. When the sand training bag is opened as a sand pit 101, it may form a sand basin or sand surface 10 within or upon which sand may be distributed to form a layer of sand over sand surface 10; a user may then use the sand covered sand surface 10 in exercises, including exercises of injured wrists for minimal resistance training as a progression or in the rehabilitation of golfer's elbow (medial epicondyle) or tennis elbow (lateral epicondyle) or similar conditions, with minimal movements increasing the blood flow.

The maximum weight the sand training bag can support depends on the size of the sand training bag and the materials used in construction. For example, it may be convenient to retail the sand training bag in a number of standard sizes designed to hold predetermined weights.

In an exemplary embodiment, the sand training bag, with no added weight from sand or other filler, is 3 pounds. The user can conveniently increase or decrease the weight of the sand training bag by adding or removing pouches or bags of sand to the interior of the bag, such as by adding or removing pouches of a predetermined weight such as 10 pounds per pouch.

In some embodiments, the sand training bag may be made of or covered in canvas or other materials which repel water, oil, and many other liquids, to allow a user to use the bag in a variety of seasons and environments. Although, in some embodiments, the sand training bag may not be recommended for use as a sand pit in situations in which moisture may increase the weight of sand in the bag in a way that is difficult to measure, such as use of the bag as a sand pit 101 outdoors during precipitation.

The sand training bag will include one or more handles 1, 2, 3, 4 for ease of use as a bag and for use with a variety of exercises. In some embodiments, the sand training bag 100 is designed to be lifted overhead, such as having handles 3 on the right end and the left end and a width dimension allowing a user to easily grasp the right end and left end handles 3 and hoist the bag overhead as in a weight lifting exercise. In some embodiments, the sand training bag 100 may also, or alternatively, include handles 1, 2, 3, 4 to allow the bag to be carried as a hand bag or to be carried in front of the user's body via top, bottom or side handles 1, 2, 3 and 4. In some embodiments, the sand training bag 100 may be made of a soft durable material such as canvas which will not substantially discomfort a user holding the bag. Although, in some embodiments, the handles 1, 2, 3, 4 of the sand training bag 100 and sand pit 101 may be formed of a material other than the material forming the walls of the bag such as a stiffer, denser, or more durable material.

The sand training bag is designed as a convenient bag which can be converted from a bag 100 to a sand pit 101, and in some embodiments the sand training bag is provided as a multipurpose tool for physical and rehabilitation needs and for general exercises.

The Enclosure

As depicted, in a bag configuration 100 the sand training bag is formed generally of a top side, a bottom side, a front side, a rear side, a right side and a left side, as indicated by the reference names of the associated handles discussed herein. As depicted particularly in FIGS. 1, 3, 5, and 8, bottom flaps 11 extend from the right and left sides and are folded against the bottom side of the bag. Bottom flaps 11 are provided to permit the bag in an open pit configuration to have a continuous perimeter sidewall formed by the top side, right side, and left side of the bag, the sidewall surrounding the sand surface 10 to contain a layer of sand thereon. Although it is to be understood that in other embodiments other wall configurations could be provided to allow the bag to be opened to form a pit having a bottom and a perimeter wall, such as including dedicated sand pit walls or wall portions to complete a sand pit perimeter side-wall without requiring the bag to include bottom flaps 11.

Bottom flaps 11 are held against the bottom side of the bag via cooperating hook-and-loop components secured to the bottom side and to the flaps. A flap fastener component 5 is secured to each flap 11, and cooperates with a surface fastener component 13 secured to the bottom side of the bag.

Wall panels, including bottom flaps 11, may be formed of a variety of durable materials such as canvas or seat belt webbing in some embodiments, and may be impermeable to water, oil and other liquids in some embodiments.

Figure 5:
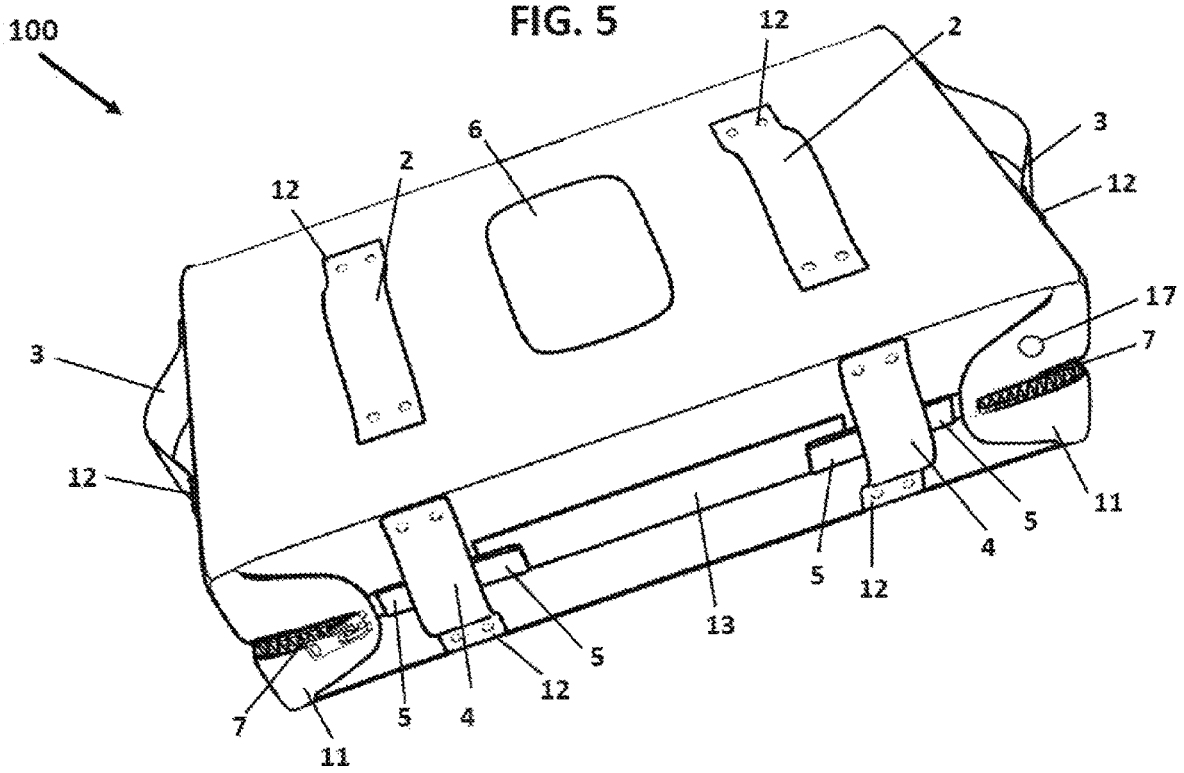
FIG. 5 is perspective view of a sand training bag according to the embodiment of FIG. 1 in a closed configuration.
Figure 6:
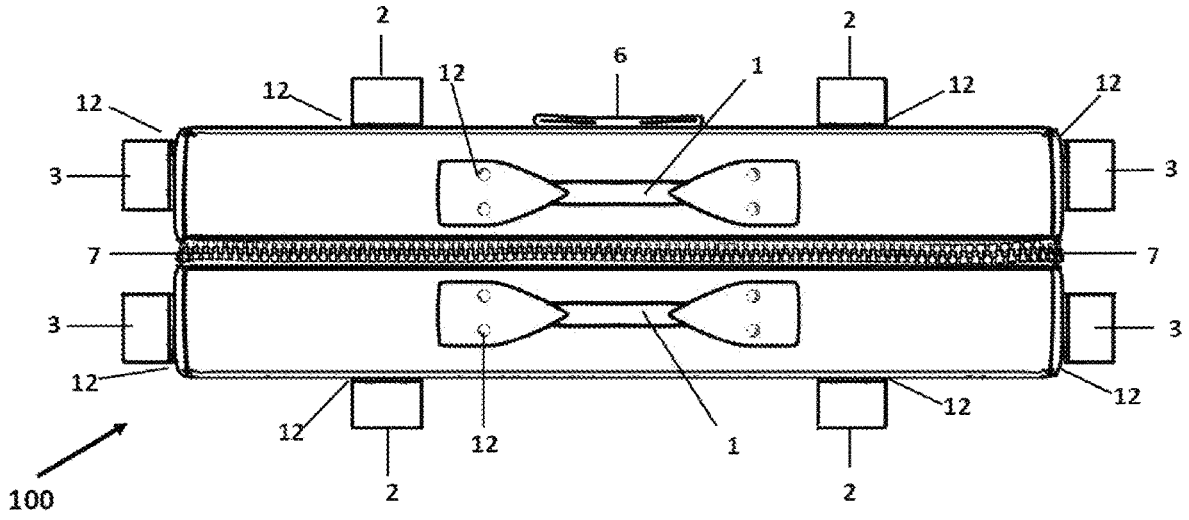
FIG. 6 is a top elevation view of a sand training bag according the embodiment of FIG. 1 in a closed configuration.
Figure 7:
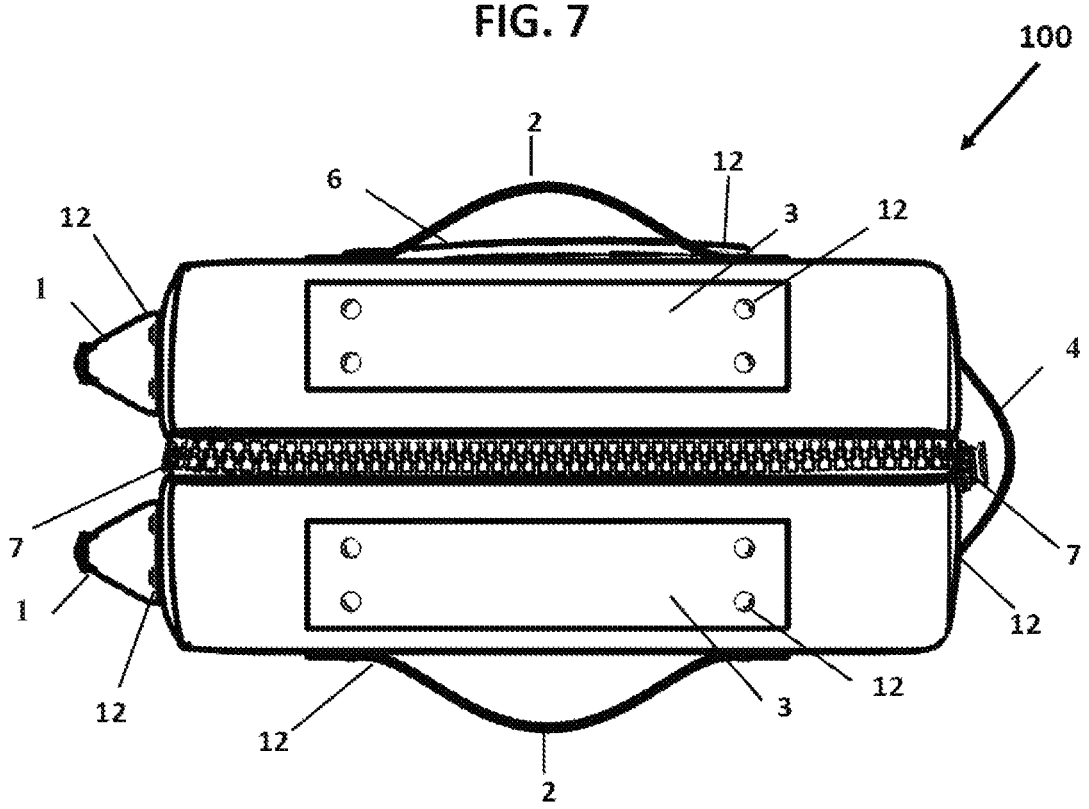
FIG. 7 is a right side elevation view of a sand training bag according to the embodiment of FIG. 1 in a closed configuration.
Figure 8:
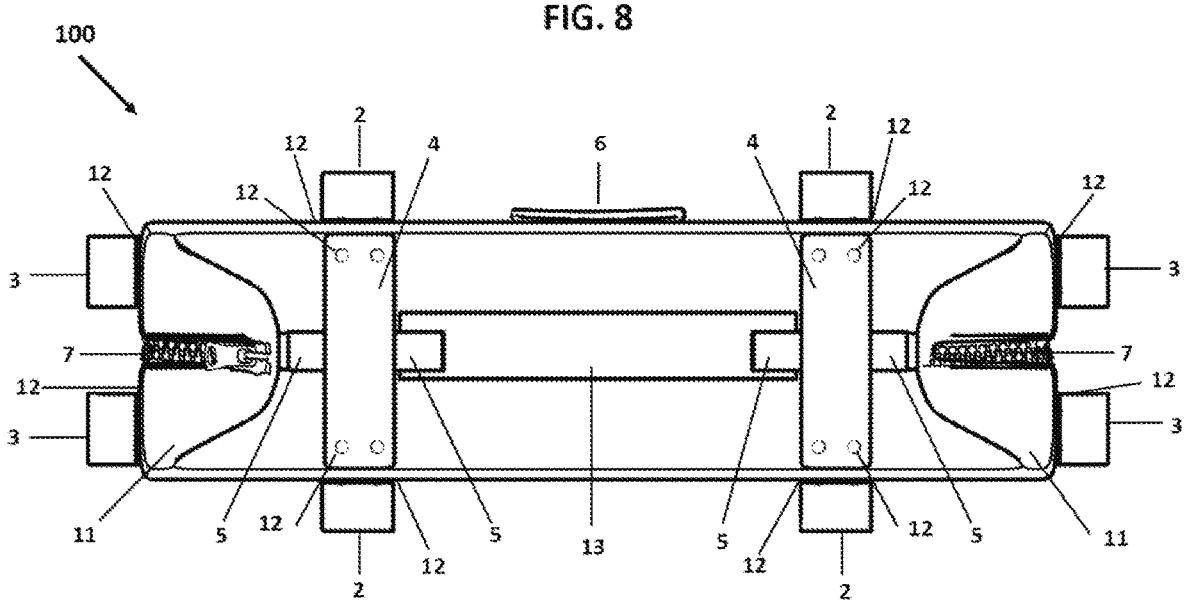
FIG. 8 is a bottom elevation view of a sand training bag according to the embodiment of FIG. 1 in a closed configuration.
Figure 9:
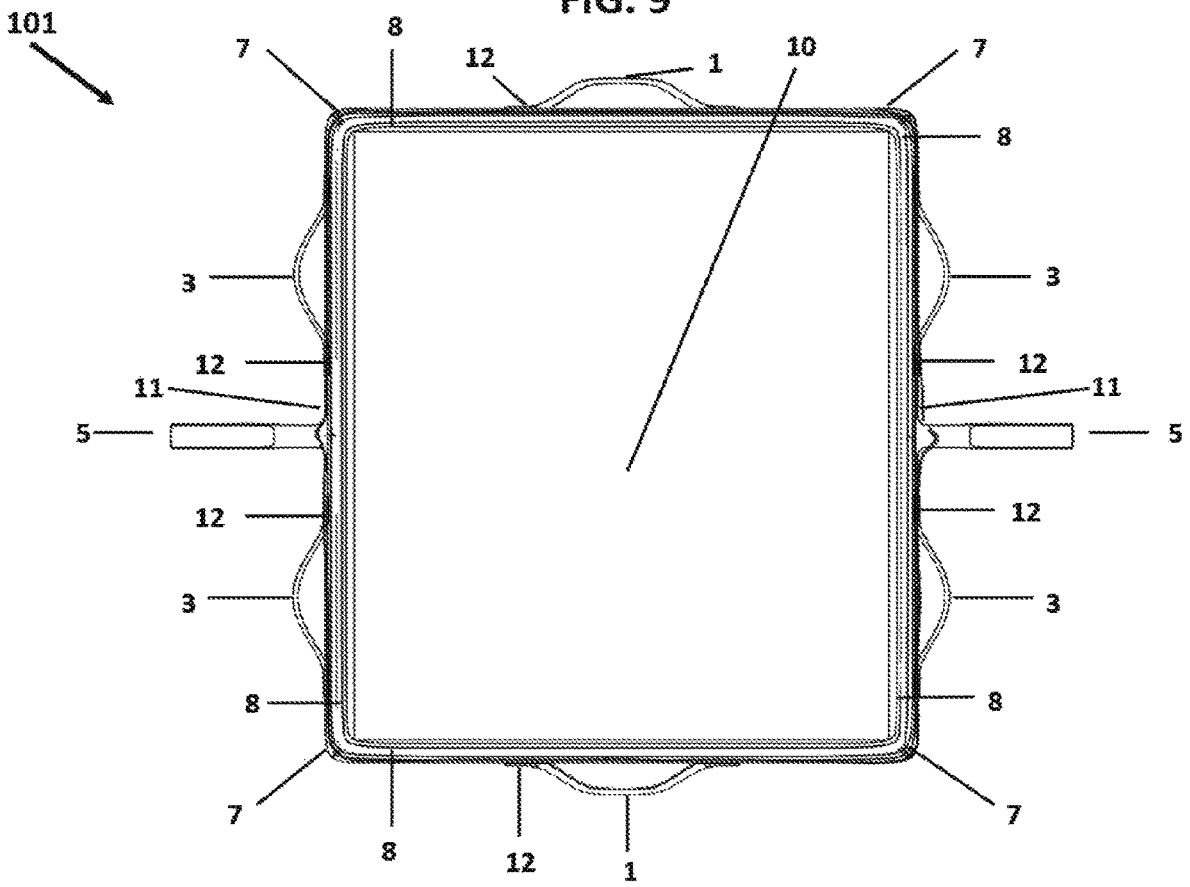
FIG. 9 is a top view of a sand surface of a sand training bag according to the embodiment of FIG. 1 in an open configuration with flaps down.
Figure 10:
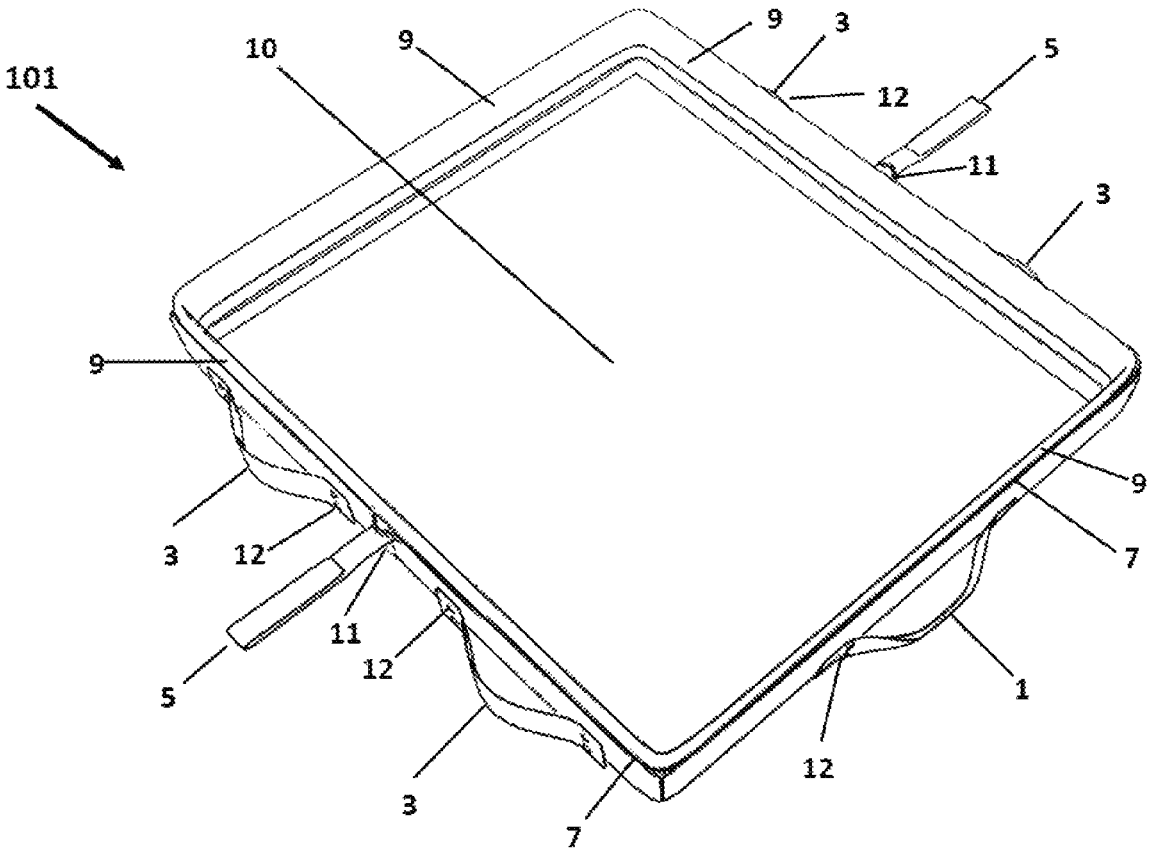
FIG. 10 is a perspective view of a sand training bag according to the embodiment of FIG. 1 in an open configuration with flaps up.
Figure 11:
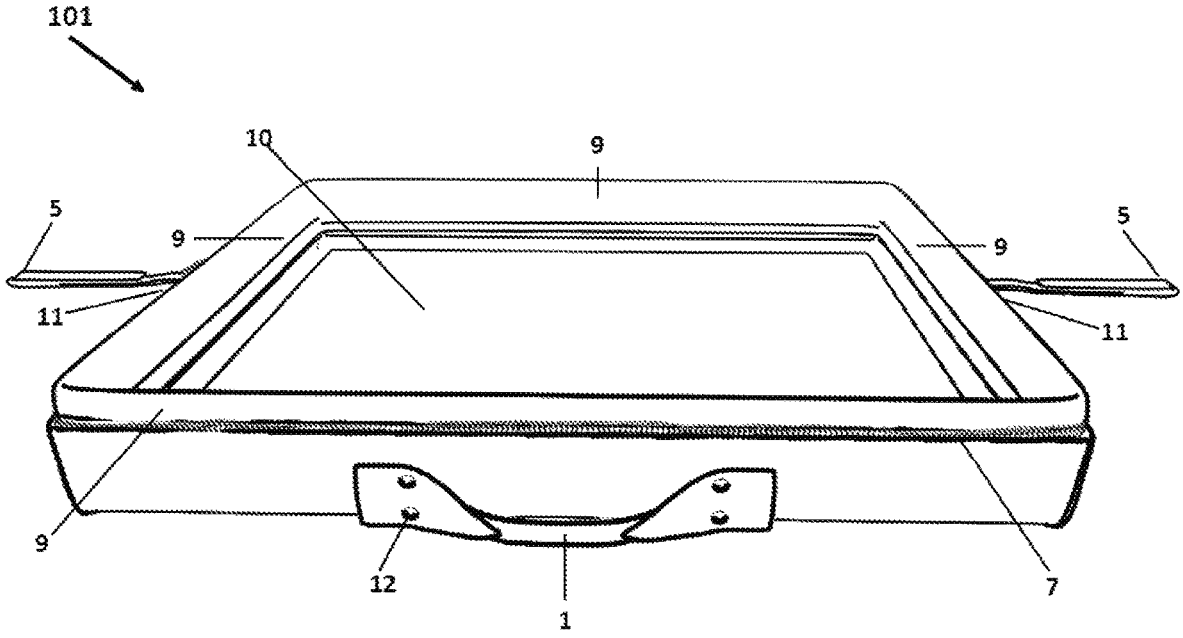
FIG. 11 is a perspective view of a sand training bag according to the embodiment of FIG. 1 in an open configuration with flaps up.
Figure 12:
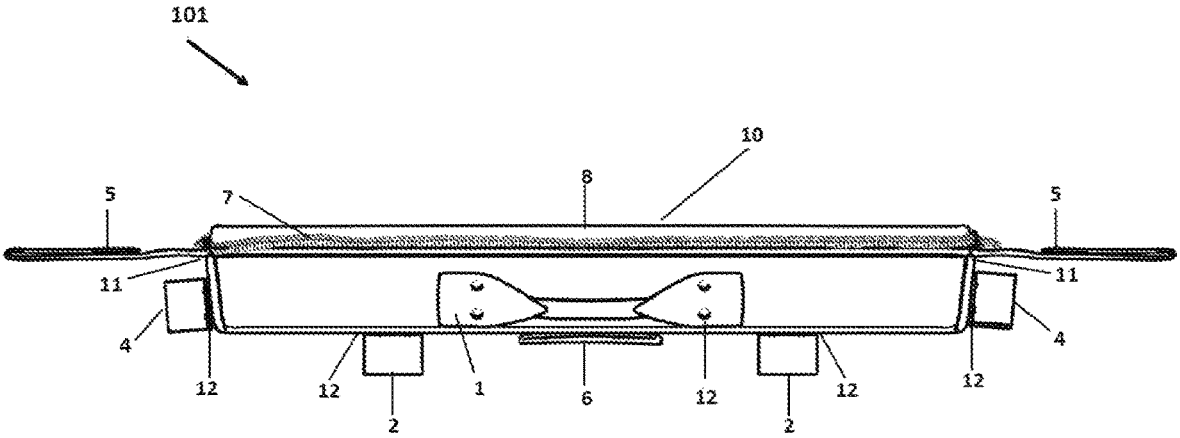
FIG. 12 is a front side elevation view of a sand training bag according to the embodiment of FIG. 1 in an open configuration with flaps down.
Figure 13:
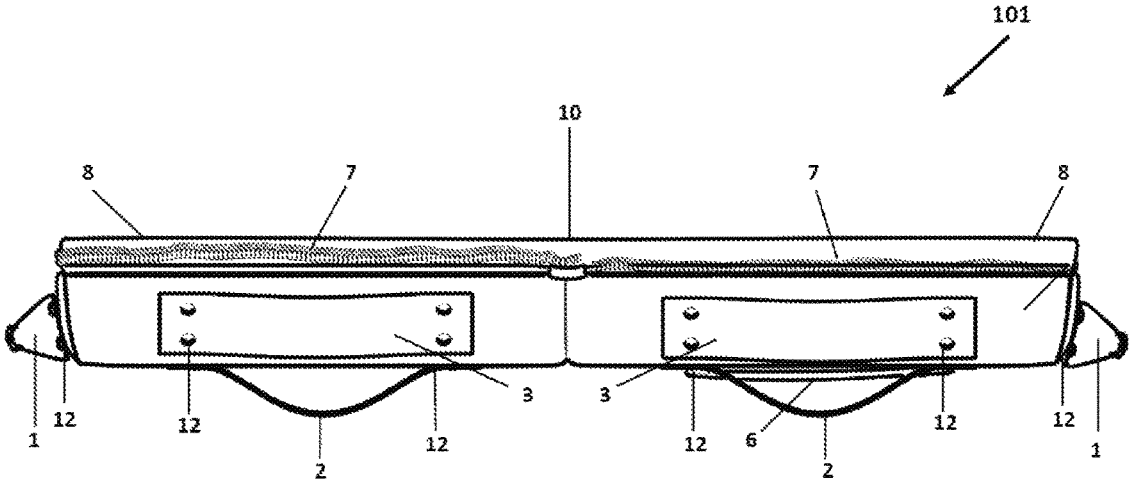
FIG. 13 is a right side elevation view of a sand training bag according to the embodiment of FIG. 1 in an open configuration with flaps down.
Figure 14:
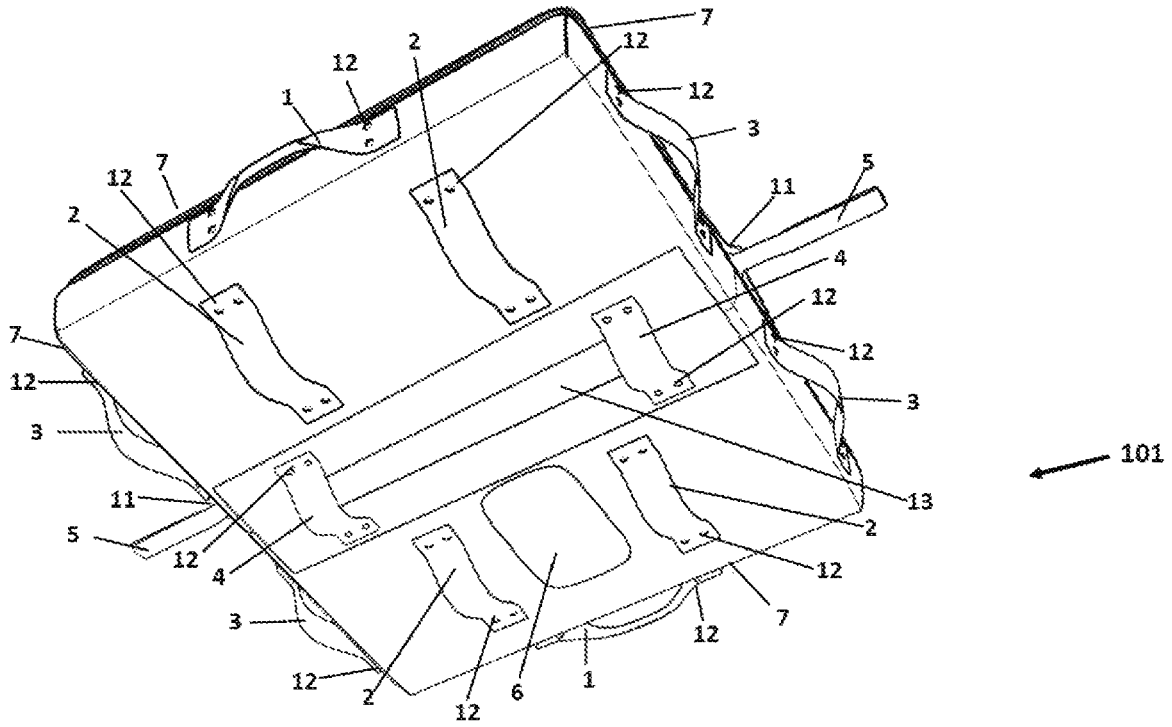
FIG. 14 is a bottom perspective view of a sand training bag according to the embodiment of FIG. 1 in an open configuration.
Figure 15:
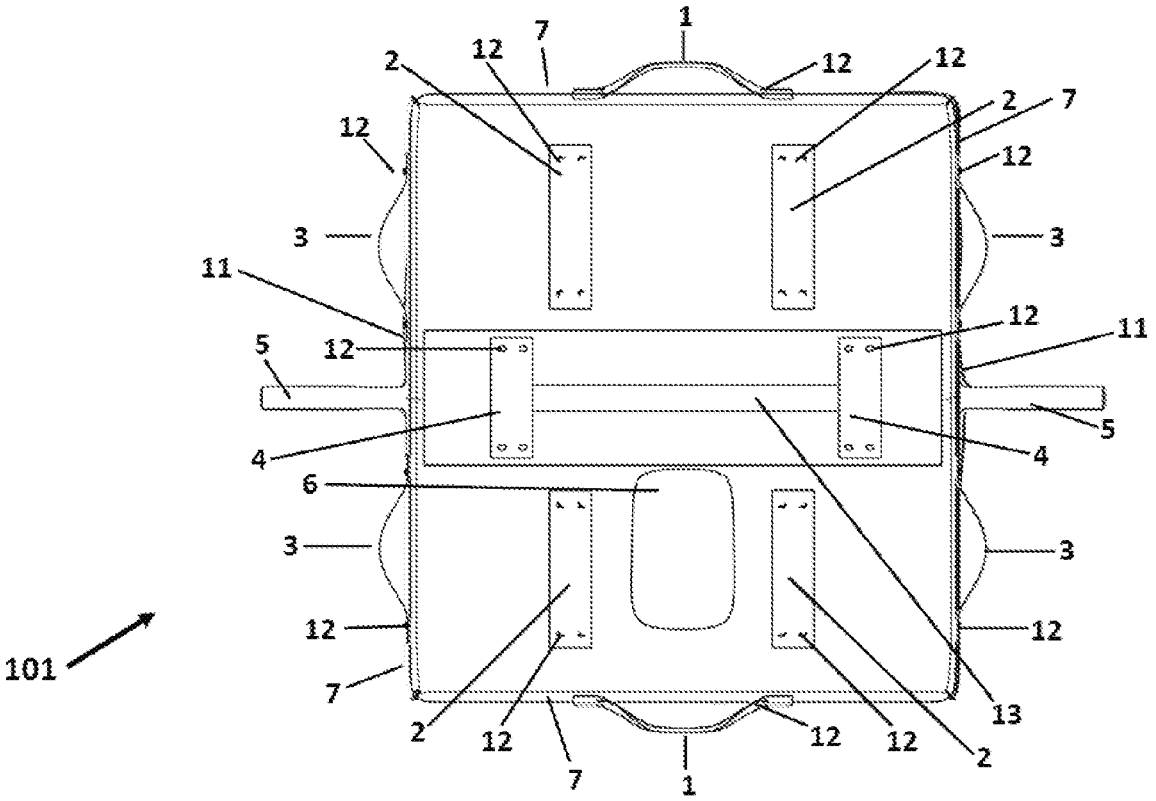
FIG. 15 is a bottom elevation view of a sand training bag according to the embodiment of FIG. 1 in an open configuration.
Figure 16:
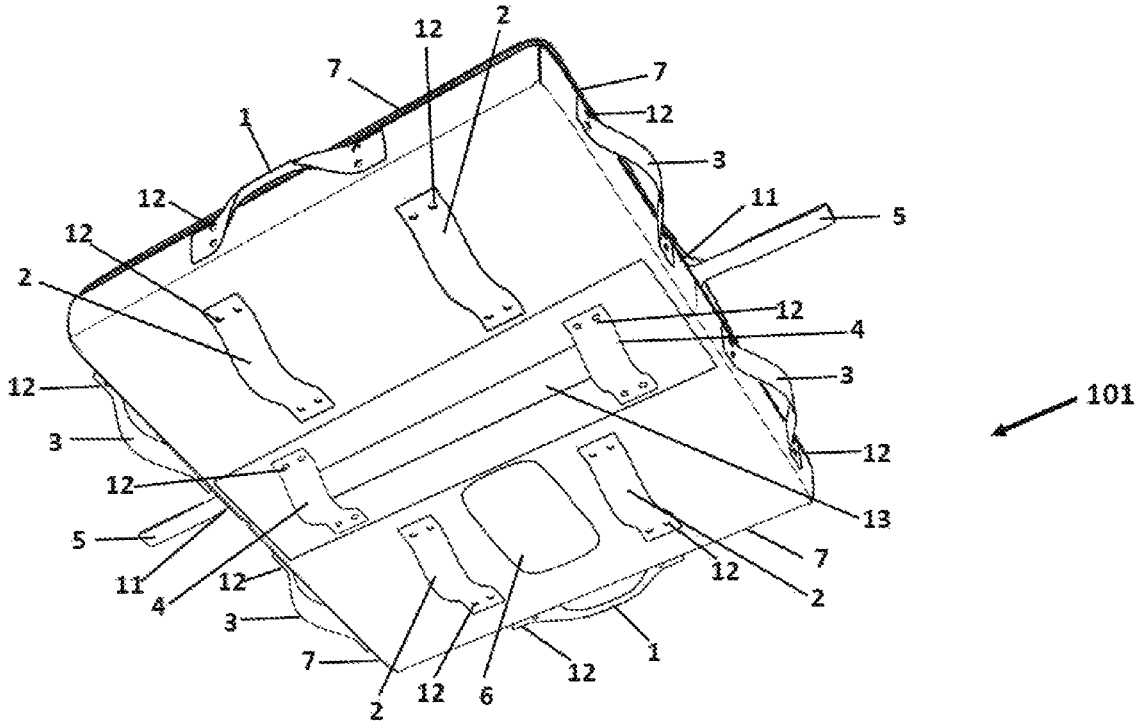
FIG. 16 is a bottom perspective view of a sand training bag according to the embodiment of FIG. 1 in an open configuration.
Figure 17:
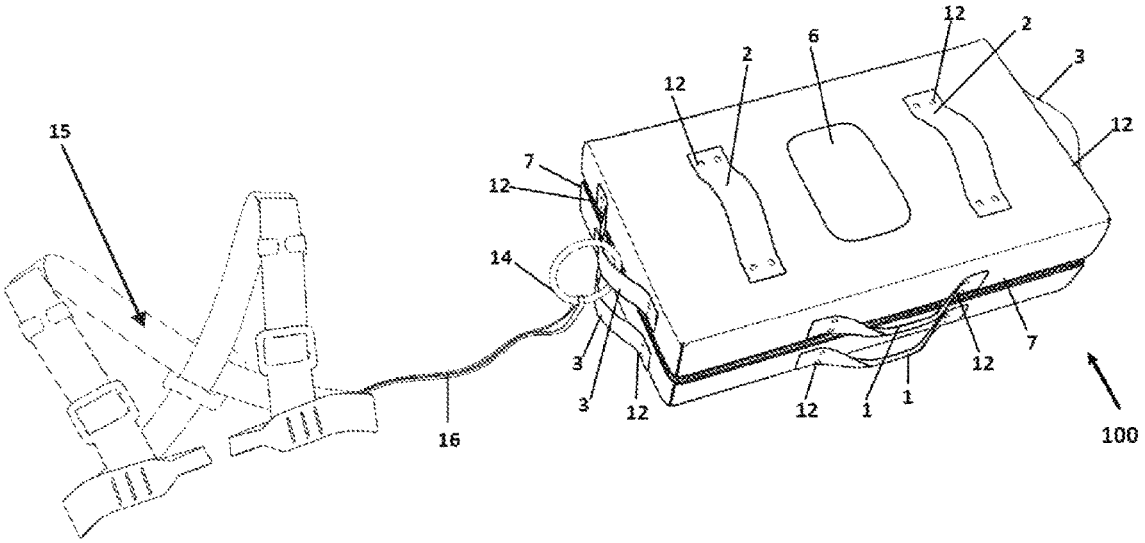
FIG. 17 is a perspective view of a sand training bag in a closed configuration with a harness and strap attached to a ring on a side handle.
Figure 18:
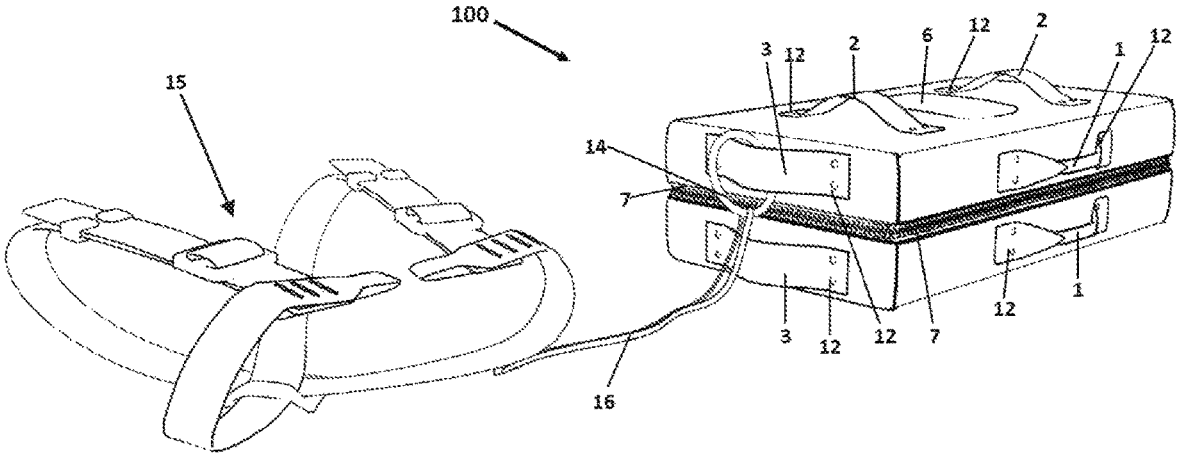
FIG. 18 is a perspective view of the sand training bag with a harness and strap according to the embodiment of FIG. 17.
Figure 19:
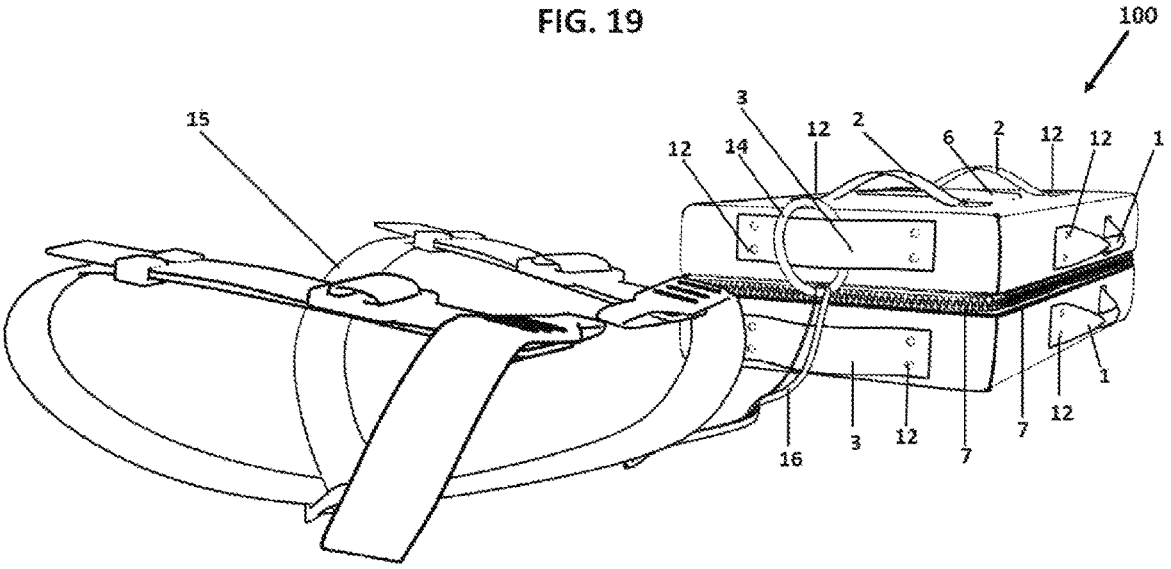
FIG. 19 is a perspective view of the sand training bag with a harness and strap according to the embodiment of FIG. 17.
Figure 20:
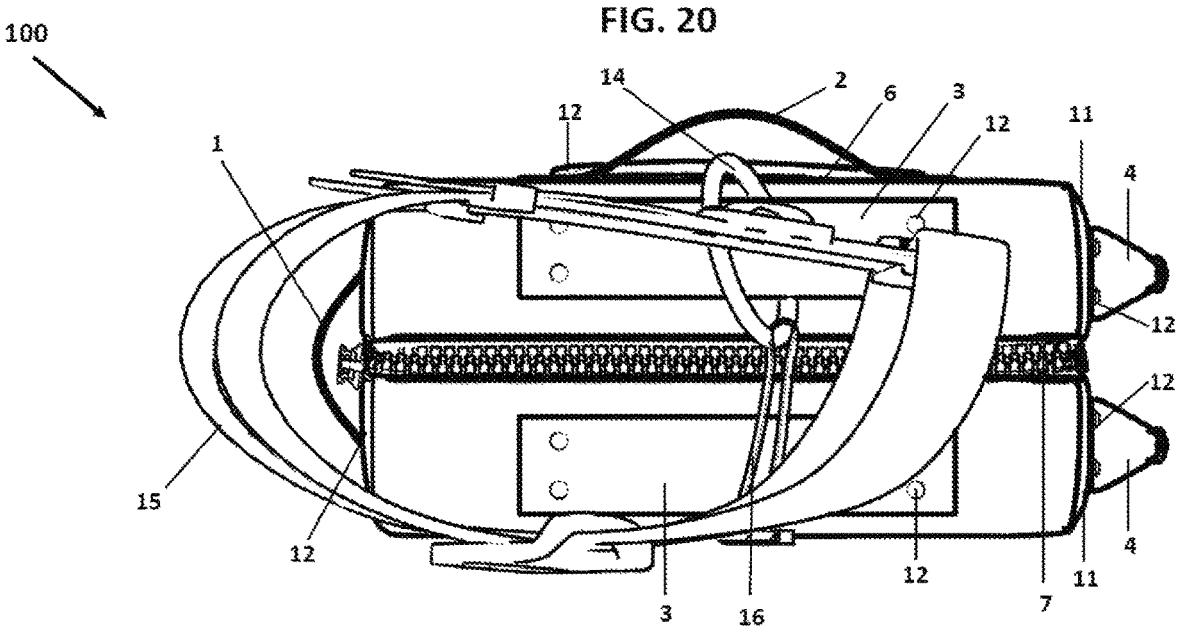
FIG. 20 is a perspective view of the sand training bag with a harness and strap according to the embodiment of FIG. 17.
Figure 21:
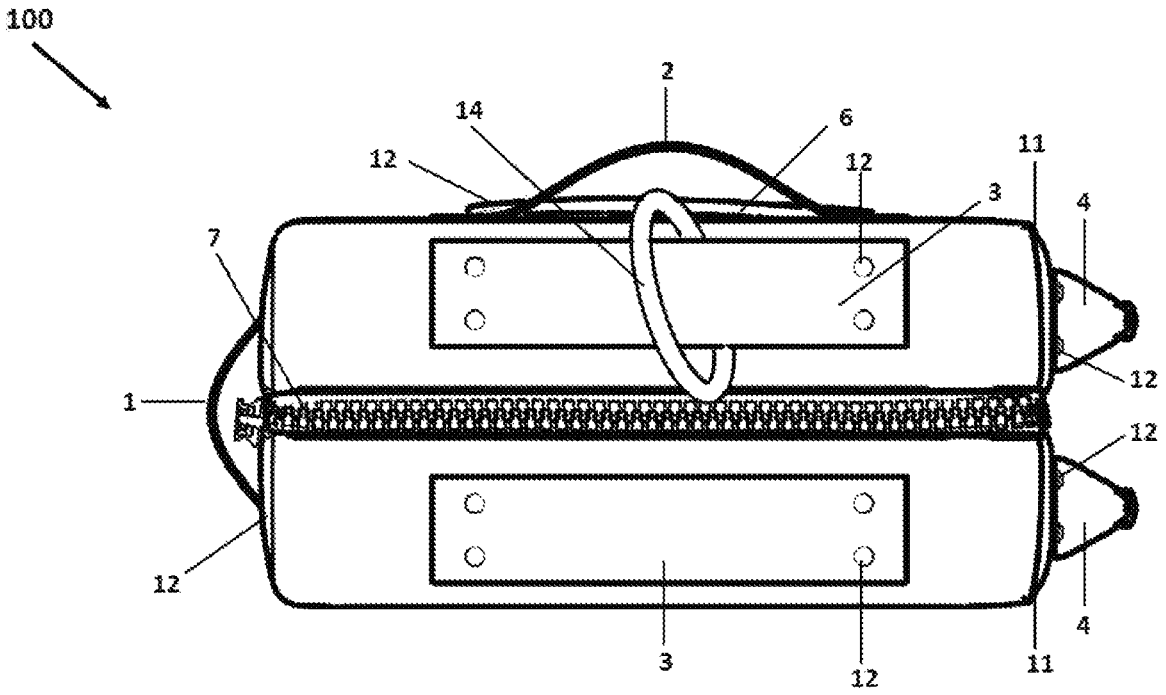
FIG. 21 is a perspective view of the sand training bag with a ring for use with a harness and strap according to the embodiment of FIG. 17.

As depicted in FIG. 5, one of the bottom flaps 11 includes a copper bounded hole 17 through which a user can pour out sand from the pit. In some embodiments each bottom flap 11 may be provided with a sand drainage hole, such as hole 17, to enable easier sand drainage. In some embodiments each flap 11 may be between 6 and 12 centimeters long.

To use the sand pit 101, the user will open sand training bag 100 by releasing flap fastener components 5 from surface fastener component 13, unzipping the zipper 7, and opening the bag to lay the front face, back face, and bottom face in a common plane to form sand surface 10, while the right side, top side, and left side of embodiment 100 form a perimeter side wall surrounding sand surface 10 to form a pit for receiving and containing a quantity of sand. The user may then pour sand into the pit to form a sand surface, such as pouring sand from five to ten pouches or bags of sand each holding up to 10 pounds of sand, though the quantity of sand would depend on the size of the pit and the needs of the user.

In the embodiment depicted, a user may extend the height of the perimeter side wall of the sand pit by deploying a bounding flap from an undeployed position 8 in which the bounding flap is folded down against the perimeter side wall to a deployed position 9 in which the bounding flap is extended upward above the perimeter side wall to increase the height of the perimeter side wall. When opening the sand training bag, the user first unzips the bag to form the sand surface 10, and then raises up a set of at least one flap running around the perimeter to form a wall around the sand surface 10, bounding flaps 8 in a lowered configuration may be raised to bounding flaps 9 in a raised configuration to increase the height of a wall formed by the basic walls of the training bag. In some embodiments, the basic walls of the bag may provide a sufficient height to the wall surrounding a sand surface, and raiseable bounding flaps are not needed.

The sand surface 10 and other components such as the bounding flap 8/9 may include multiple layers to improve durability and other desirable qualities. In some embodiments, each flap 8, 9 has three layers; a layer of canvas, a layer of vinyl, and a layer of shark skin, with the shark skin layer forming the sand-facing surface of the flap. In some embodiments, the sand surface 10 is first made from a layer of vinyl, a layer of shark skin, and then another layer of vinyl, the final layer of vinyl included to provide padding such as to provide a low impact surface even if the layer of sand added by the user is inadequately covering the sand surface 10.

The top layer of durable sand surface 10 may be made from shark skin, vinyl and other durable material in some embodiments. The surface may also be chosen to provide enough surface friction to keep the sand from flowing freely across the surface, such as shark skin or vinyl.

In example embodiments, the dimensions of the sand training bag may be as follows: the opened sand surface 10 may have a length of between 8 and 60 centimeters and a width of between 5 and 40 centimeters. The length of the bounding flap 8/9 may be between 6 and 60 centimeters with a height of between 4 and 16 centimeters. In some embodiments, the closed configuration dimensions of the sand training bag are a length of between 6 and 48 centimeters, a height of between 5 and 20 centimeters, and a width of between 3 and 15 centimeters The sand surface 10 is built to be used with a variety of activities including explosive physical movements, such as Plyometrics (jumping, sprinting, accelerating, lateral hops). However, most speed training and rehabilitation exercises are low impact movements and would not cause significant damage to the sand training bag.

When a user has finished using the sand pit of sand pit bag embodiment 101, the user may reconfigure the sand training bag as a bag by lowing the bounding flap 8/9, pouring the sand out of bag through copper bounded hole 17 into pouches or bags or a beach or other surface, doing up zipper 7, folding bottom flaps 11 back against the bottom face, and securing flap fasteners 5 to surface fastener 13. Zipper 7 is provided to hold the bag in a closed configuration, and may, for example, be a plastic or metal zipper designed to provide sufficient strength to the bag to hold the weight of the bag and may also be designed in some embodiments to provide a sand- or even liquid-impermeable seal.

Sand Pouches

In many embodiments the sand training bag will be provided with pouches (not shown) for holding sand. The pouches may be supplied with sand, or a user may be required to fill the pouches themselves. The pouches may be designed to allow sand to be neatly contained when not needed, such as to not mix loosely with other contents of the sand training bag. The pouches may also be designed to allow the sand to be poured onto a sand surface provided by the sand training bag in an open configuration, such as onto surface 10 of the bag in configuration 101, to form a sand surface. The sand pouches in some embodiments are made of shark skin or other material which is durable and water, oil, dirt, and liquid repellant. In some embodiments each pouch is configured to hold 10 lbs of sand, such as by being formed of heavy canvas or shark skin in a suitable size.

In some embodiments, the pouches may be fastened to the training bag, such as to allow a user to securely fasten the pouches inside the sand training bag when transporting the pouches or when using the bag as a weight. For example, the training bag and pouches may include cooperating hook-and-loop fastener components to allow the pouches to be secured to an interior surface of the sand training bag. In some embodiments, the pouches are secured to the training bag via hook and loop fasteners formed of or on rigilene polyester boning. A durable and waterproof construction allows a user to carry the sand pouches in any weather condition with minimal damage.

Also, the sand pouches can be an alternative option for isolation workouts. The pouches in some embodiments will be formed of semi-ridged material forming rectangular shapes to allow the pouches to be more easily stacked on top of each other and bi laterally within the bag for optimized storage and to allow a user to maximize the weight of the bag when used as a weight. Although in other embodiments the pouches may be made of a flexible material and may still be able to be stacked on top of each other and bilaterally.

In some embodiments, the pouches may each be formed of two volume carrying portions in a saddlebag-style configuration, such as each portion able to hold 5 pounds of sand. The pouches may be approximately 8 centimeters long and 15 centimetres high.

In some embodiments the pouches are closed using hook-and-loop fasteners, and in some embodiments the pouches include a handle or other gripping surface to be used in lifting them in and out of the bag.

In some embodiments, each pouch is made from shark skin. The handle may be made from seat belt webbing on each side of the pouch in some embodiments. Hook-and-loop fasteners may be found on the top to open and close the pouches in some embodiments. The lining underneath the hook-and-loop is made of Rigilene Boning in some embodiments.

Harness

In some embodiments the training bag may be provided with a harness secured to the bag. An example harness and securing structure are shown in FIGS. 17 to 23. The harness 15 with the strap 16 is used as an assisted conditioning tool for the user while walking, jogging, running, sprinting and all other forms of acceleration. The harness 15 is attached to the strap 16 which is then connected to a metal ring 14 located on the side handle 3. When finished the task, the user can detach the strap 16 from the ring 14 and place the harness 15 and strap 16 in the open configuration of the sand training bag 100. The use of a ring 14 on a side handle 3 allows the strap to be easily attached and detached from the bag, although other attachment mechanisms could be used as well.

Use

Embodiments of the sand training bag of the present description will be beneficial for every training facility, physical rehabilitation clinic and outdoor settings. Many training facilities and rehabilitation centers around the globe do not incorporate sand training in either training or rehabilitation programs and treatment. As a result of the many benefits of sand training, the provision of the portable, effective, and multi-use sand training bag of embodiments of the present invention may greatly expand the potential of sand training.

The user of sand training bag 100 can hold the sand training bag 100 from the side handles 3, the top handles 1 or any desired grip, and may adjust the weight of the bag by adding or removing content such as sand pouches.

In embodiments, the sand pouches are held closed via a hook-and-loop fastener and may be conveniently unfolded from the hook-and-loop fastener to discharge a contained quantity of sand, such as ten pounds of sand, into the sand surface 10 when sand training bag 100 has been opening for use as a sand pit 101. When the activity is completed in the sand pit 101, one or more persons can close or partly close the bag to enable the contained sand to be gathered easily to a part of the sand training bag, and poured out through the copper bounded hole 17, such as into one or more available pouches. A user may first zip up the bag to enable sand to be easily poured out through hole 17 or may simply partly fold the bag into a closed position to allow the sand to be easily gathered near the hole 17. The user could then pour the sand from a 45-130-degree angle into the sand pouch, then open the sand training bag 100 and place the sand pouches inside, such as stacked on one another bi-literally for easy storage in the bag, such as for transport when the bag is in a closed configuration. In other embodiments, no sand pouches may be provided, or sand pouches may have other configurations or elements. It is to be understood that in some embodiments hole 17 is not provided and a user scoops or pours out sand from the bag through the top opening of the sand pit.

Many athletes seek out a local beach or other sand training location for sand training. The sand training bag of the present description may be used for speed, strength and rehabilitation training, both in many of the ways a natural sand surface may be used and in other ways herein described. The sand training bag of the present description may also be provided in association with an in-depth training program and a set of physical rehabilitation guidelines, such as for use as a kit or program for rehabilitation. In some embodiments, the program will present and be based on evidence-based programs and results, such as based on programs developed by MLB, NBA, NHL, NFL and CFL strength and conditioning coaches, athletic therapists, medical professionals and personal trainers.

The sand training bag 100 and sand pit 101 is not only made for athletes, but can also be used by the general population. Science-based research indicates that sand surface training is more effective for VO2 max training than training on other surfaces. Also, in some embodiments the risk of injury is decreased by the use of a low impact (sand) surface. In some embodiments, the sand training bag may provide users with a more effective workout in a shorter amount of time. The provision of sand draining structure in some embodiments also assists in making the sand training bag suitable for use in an indoor setting, for example since sand can be neatly contained in the pit, and in some embodiments can be drained from the sand training bag 100 from the hole 17 when training tasks have been completed and the user is ready to pack up the bag.

In some embodiments, the dimensions and other characteristics such as weight of the sand training bag and sand pit may be chosen to allow it to be transported around by one or more user. The sand training bag can be closed into a bag configuration to provide a convenient look and function, such as to be easily carried onto a plane, bus or other vehicle, with or without any sand pouches.

The following is a listing of reference numbers and associated elements of the sand training bag embodiments depicted in the figures:

1 Top handles;
2 Face and rear side handles;
3 Right and left side handles;
4 Bottom handles;
5 Flap fastener components;
6 Optional logo;
7 Zipper;
8 Bounding flaps when down;
9 Bounding flaps when up;
10 Sand receiving surface;
11 Bottom flaps;
12 Rivets;
13 Surface fastener component;
14 Ring;
15 Chest and waist harness;
16 Joining strap;
17 Copper framed hole/drainer;
18 Flat surface rear face
100 Sand training bag when in a bag configuration; and
101 Sand training bag when in an open pit configuration.

In some embodiments, a sand training bag is a multi purpose piece of training equipment, for a number of exercises. The sand training bag may be designed to support 50-100 pounds, depending on the selected size by the user and the materials used.

In some embodiments, the sand training bag may include built-in structure (not shown) to hold sand rather then requiring a user to pour sand into a pit and then remove the sand from the interior of the bag when complete. For example, the sand training bag may include a sub compartment into which the sand can be moved once a sand training exercise is complete, which may be closed to hold the sand from being loosely deposed within the interior of the bag.

In some embodiments, the sand surface 10 may be overlayed with a cover or liner (not shown) provided to contain sand deposited on the sand surface 10, and a user may be able to fold up the cover or liner with the sand contained when they have finished their sand training exercises. In some embodiments the sand surface cover or liner may be secured to the sand surface or other internal surface of the bag such as via hook-and-loop fastener, adhesive, or stitching, such as to allow the cover to form a sub compartment or pouch within the bag when not deployed, while in some embodiments the sand surface cover or liner may be loosely deposited over the sand surface 10 such that a user may remove it from the bag to shake out sand or to store separately.

In embodiments in which sand does not need to be poured out of the pit, a sand drainage hole may not be provided.

It is to be understood that while the sand training bag has been depicted as a rectangular bag when in a closed configuration, providing a substantially flat sand surface 10, in other embodiments the bag may be less structured. In some embodiments the bag may include one or more full or partial liners, and in some embodiments the bounding flap or flaps may be secured to the liner rather than to the external wall panels of the bag. In some embodiments structural components may be included, such as supports for the walls of the bag while in other embodiments the shape of the bag may be defined only by the rigidity and relative configuration of the wall panels.

It is to be understood that all references to particular materials and dimensions are provided to detail example embodiments, and may not define the composition and dimensions of all embodiments.

Various embodiments of the invention have been described in detail. Since changes in and or additions to the above-described best mode may be made without departing from the nature, spirit or scope of the invention, the invention is not to be limited to those details but only by the appended claims.

What is claimed is:

1. A sand training bag for sand training, comprising:

a set of bag walls including a training surface wall and a perimeter wall, and wherein the sand training bag is transitionable between a closed bag configuration in which the set of bag walls defines a bag chamber to an open pit configuration in which the set of bag walls forms a sand training pit with the training surface wall forming a floor of the sand training pit and the perimeter wall forming a perimeter side wall of the sand training pit, the sand training pit provided to receive and hold a quantity of sand;

wherein the perimeter wall defines an at least one drainage hole for a passage of sand through the perimeter wall.

2. The sand training bag according to claim 1, wherein the sand training bag is made to hold the quantity of sand, and the quantity of sand weighs between 50 and 100 pounds.

3. The sand training bag according to claim 1, further comprising a fastener, wherein the fastener is a zipper deposited about a periphery of the perimeter wall for holding the sand training bag in the closed bag configuration.

4. The sand training bag of claim 3, wherein the zipper is a sand impermeable zipper to prevent any leakage of the quantity of sand from the bag chamber.

5. The sand training bag according to claim 1, further comprising a set of at least one handle on an exterior surface of the sand training bag.

6. The sand training bag of claim 5, wherein each handle of the set of at least one handle is made of seat belt webbing and is secured to the exterior surface by a set of at least one rivet.

7. The sand training bag according to claim 5, wherein each handle of the set of at least one handle has a length between 6 and 12 centimeters, a height between 1 and 4 centimeters, and a width between 1 and 2 centimeters.

8. The sand training bag according to claim 5, wherein the set of at least one handle is at least two handles arranged to permit a user to hoist the sand training bag as a weight.

9. The sand training bag according to claim 1, wherein the perimeter wall forms a set of two bottom flaps when the sand training bag is in the closed bag configuration, the set of two bottom flaps each securable to an exterior surface of the sand training bag via a hook and loop fastener.

10. The sand training bag according to claim 1, wherein the bag chamber has a length between 6 and 48 centimeters, a height between 5 and 20 centimeters, and a width between 3 and 15 centimeters.

11. The sand training bag according to claim 1, further comprising a set of sand pouches.

12. The sand training bag according to claim 11, wherein each sand pouch is made of shark skin.

13. The sand training bag according to claim 1, wherein the perimeter wall is deployable when the sand training bag is in the open pit configuration to raise the perimeter side walls of the sand training pit to a height between 4 and 16 centimeters.

14. The sand training bag according to claim 13, wherein the set of bag walls is each formed of a layer of canvas, a layer of vinyl, and a layer of shark skin.

15. The sand training bag according to claim 1, further comprising a cover for lining the sand training pit to contain the quantity of sand deposited in the sand training pit.

16. The sand training bag according to claim 1, further comprising a harness secured to the sand training bag via a strap and provided for a user to drag the sand training bag as a weight.

* * * * *